US006377759B1

(12) United States Patent
Abe et al.

(10) Patent No.: US 6,377,759 B1
(45) Date of Patent: Apr. 23, 2002

(54) PROCESS CARTRIDGE, ELECTROPHOTOGRAPHIC IMAGE FORMING APPARATUS AND DEVELOPER AMOUNT DETECTING MEMBER

(75) Inventors: Daisuke Abe, Shizuoka-ken; Kazushi Watanabe; Toru Oguma, both of Mishima; Takao Nakagawa, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/661,392

(22) Filed: Sep. 13, 2000

(30) Foreign Application Priority Data

Sep. 17, 1999 (JP) ..... 11-264207

(51) Int. Cl.[7] ..... G03G 15/08
(52) U.S. Cl. ..... 399/27; 399/61
(58) Field of Search ..... 399/27, 61; 73/304 C

(56) References Cited

U.S. PATENT DOCUMENTS

| | | | |
|---|---|---|---|
| 5,095,335 A | 3/1992 | Watanabe et al. | 355/210 |
| 5,151,734 A | 9/1992 | Tsuda et al. | 355/200 |
| 5,208,634 A | 5/1993 | Ikemoto et al. | 355/215 |
| 5,223,893 A | 6/1993 | Ikemoto et al. | 355/200 |
| 5,294,960 A | 3/1994 | Nomura et al. | 355/210 |
| 5,331,372 A | 7/1994 | Tsuda et al. | 355/200 |
| 5,345,294 A | 9/1994 | Nomura et al. | 355/200 |
| 5,404,198 A | 4/1995 | Noda et al. | 355/200 |
| 5,455,665 A | 10/1995 | Baba et al. | 355/298 |

(List continued on next page.)

FOREIGN PATENT DOCUMENTS

| | | | |
|---|---|---|---|
| EP | 0992862 | | 4/2000 |
| EP | 0992866 | | 4/2000 |
| JP | 2-39179 | * | 2/1990 |
| JP | 2000-122397 | | 4/2000 |
| JP | 2000-122398 | | 4/2000 |

*Primary Examiner*—Joan Pendegrass
(74) *Attorney, Agent, or Firm*—Fitzpatrick, Cella, Harper & Scinto

(57) ABSTRACT

A process cartridge detachably mountable to an electrophotographic image forming apparatus main body includes an electrophotographic photosensitive member, a process device acting on the electrophotographic photosensitive member, a measuring electrode member disposed in a part contacting developer and provided with an input side electrode and an output side electrode having at least a pair of portions disposed in parallel with a fixed interval, a reference electrode member disposed in a part not contacting the developer and provided with an input side electrode and an output side electrode having at least a pair of portions disposed in parallel with a fixed interval, an output contact for a measuring electrode electrically connected to the output side electrode of the measuring electrode member, an output contact for a reference electrode electrically connected to the output side electrode of the reference electrode member, and an input contact electrically connected to the input side electrodes of the measuring electrode member and the reference electrode member. Values of the electrostatic capacitance respectively generated by the measuring electrode member and the reference electrode member are different when voltage is impressed on the measuring electrode member and the reference electrode member with the process cartridge inserted in the apparatus main body.

63 Claims, 21 Drawing Sheets

U.S. PATENT DOCUMENTS 5,463,446 A 10/1995 Watanabe et al. ..... 355/200
5,465,136 A 11/1995 Watanabe et al. ..... 355/210
5,470,635 A 11/1995 Shirai et al. ..... 428/131
5,475,470 A 12/1995 Sasago et al. ..... 355/210
5,488,459 A 1/1996 Tsuda et al. ..... 355/211
5,510,878 A 4/1996 Noda et al. ..... 355/211
5,561,504 A 10/1996 Watanabe et al. ..... 355/215
5,583,613 A 12/1996 Kobayashi et al. ..... 355/200
5,602,623 A 2/1997 Nishibata et al. ..... 399/111
5,608,509 A 3/1997 Shirai et al. ..... 399/351
5,623,328 A 4/1997 Tsuda et al. ..... 399/111
5,640,650 A 6/1997 Watanabe et al. ..... 399/117
5,659,847 A 8/1997 Tsuda et al. ..... 399/113
5,669,042 A 9/1997 Kobayashi et al. ..... 399/111
5,768,658 A 6/1998 Watanabe et al. ..... 399/111
5,768,660 A 6/1998 Kurihara et al. ..... 399/111
5,790,923 A 8/1998 Oguma et al. ..... 399/106
5,794,101 A 8/1998 Watanabe et al. ..... 399/103
5,809,374 A 9/1998 Tsuda et al. ..... 399/111
5,812,909 A 9/1998 Oguma et al. ..... 399/103
5,828,928 A 10/1998 Sasago et al. ..... 399/111
5,878,304 A 3/1999 Watanabe et al. ..... 399/92
5,884,124 A 3/1999 Karakama et al. ..... 399/123
5,903,803 A 5/1999 Kawai et al. ..... 399/116
5,923,918 A 7/1999 Nakagawa et al. ..... 399/27
5,937,242 A 8/1999 Yokoyama et al. ..... 399/114
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,041,196 A 3/2000 Nakagawa et al. ..... 399/27
6,070,028 A 5/2000 Odagawa et al. ..... 399/104
6,075,956 A 6/2000 Watanabe et al. ..... 399/92
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,118,960 A 12/2000 Nakagawa et al. ..... 399/111

* cited by examiner

PROCESS CARTRIDGE, ELECTROPHOTOGRAPHIC IMAGE FORMING APPARATUS AND DEVELOPER AMOUNT DETECTING MEMBER

BACKGROUND OF THE INVENTION

1. Field of the Invention

This invention relates to a process cartridge and an electrophotographic image forming apparatus to which the process cartridge is detachably mountable, and further to a developer amount detecting member.

Here, an electrophotographic image forming apparatus includes, for example, an electrophotographic copying machine, an electrophotographic printer (for example, an LED printer, a laser beam printer and the like), an electrophotographic facsimile apparatus, an electrophotographic word processor and so on.

In addition, a process cartridge makes at least one of charging means, developing means and cleaning means, and an electrophotographic photosensitive member integrally into a cartridge that is detachably mountable to an electrophotographic image forming apparatus main body, or makes at least developing means and an electrophotographic photosensitive member integrally into a cartridge that is detachably mountable to an electrophotographic image forming apparatus main body.

2. Related Background Art

Conventionally, in an electrophotographic image forming apparatus using an electrophotographic image forming process, the process cartridge method is adopted that makes an electrophotographic photosensitive member and process means acting on the electrophotographic photosensitive member integrally into a cartridge which is detachably mountable to an electrophotographic image forming apparatus main body. In accordance with the process cartridge method, since the maintenance of the apparatus can be conducted by a user in person and not by a serviceman, the operability can be considerably improved. Hence, the process cartridge method is widely used in electrophotographic image forming apparatuses.

In such an electrophotographic image forming apparatus, means for informing a user of the depletion of the developer, that is, a developer amount detecting apparatus, is provided.

Conventionally, as a developer amount detecting apparatus, there is one that has two electrode rods in a developer container of developing means and detects a change in electrostatic capacitance between the two electrode rods to detect the developer amount.

In addition, Japanese Patent Application Laid-open No. 5-100571 discloses a developer amount detecting apparatus provided with a developer detecting electrode member that is formed by interdigitating two parallel electrodes disposed in parallel on the same plane with a predetermined interval instead of two electrode rods, and that is disposed in the bottom surface of the developer container. This apparatus is for detecting a developer remaining amount by detecting a change in electrostatic capacitance between the parallel electrodes disposed in an flat state.

However, each of the above-mentioned developer amount detecting apparatus merely detects the existence of developer in a developer container, that is, each apparatus can only detect that a developer remaining amount is low immediately before the developer in the developer container is depleted, but cannot detect how much developer remains in the developer container.

On the other hand, if a developer remaining amount in a developer container can be successively detected, it is possible for a user to know the usage status of developer in the developer container and to prepare a new process cartridge at a time for replacement that is extremely convenient to the user.

SUMMARY OF THE INVENTION

The present invention has been made in view of the above problems, and therefore has an object thereof to provide a process cartridge, an electrophotographic image forming apparatus and a developer amount detecting member capable of successively detecting a remaining amount of a developer.

It is another object of the present invention to provide a process cartridge, an electrophotographic image forming apparatus and a developer amount detecting member which are provided with a developer amount detecting apparatus capable of successively detecting a remaining amount of the developer in accordance with the consumption of developer in a developer container, and can improve the convenience for a user in using the apparatus.

It is another object of the present invention to provide a process cartridge, an electrophotographic image forming apparatus and a developer amount detecting member that can realize:

(1) miniaturization of a developer amount detecting member and the resulting miniaturization of a cartridge and a developer amount detecting apparatus;

(2) improvement in detection accuracy when a developer amount detecting member is placed within a limited area; and (3) decrease the cost of parts and the assembly costs.

It is another object of the present invention to provide a process cartridge, an electrophotographic image forming apparatus and a developer amount detecting member having different values of electrostatic capacitance generated by each of a measuring electrode member and a reference electrode member when voltage is impressed on the measuring electrode member and the reference electrode member.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A process cartridge, an electrophotographic image forming apparatus and a developer amount detecting member of the present invention will be hereinafter described more in detail with reference to the drawings.

(First Embodiment)

Figure 1:
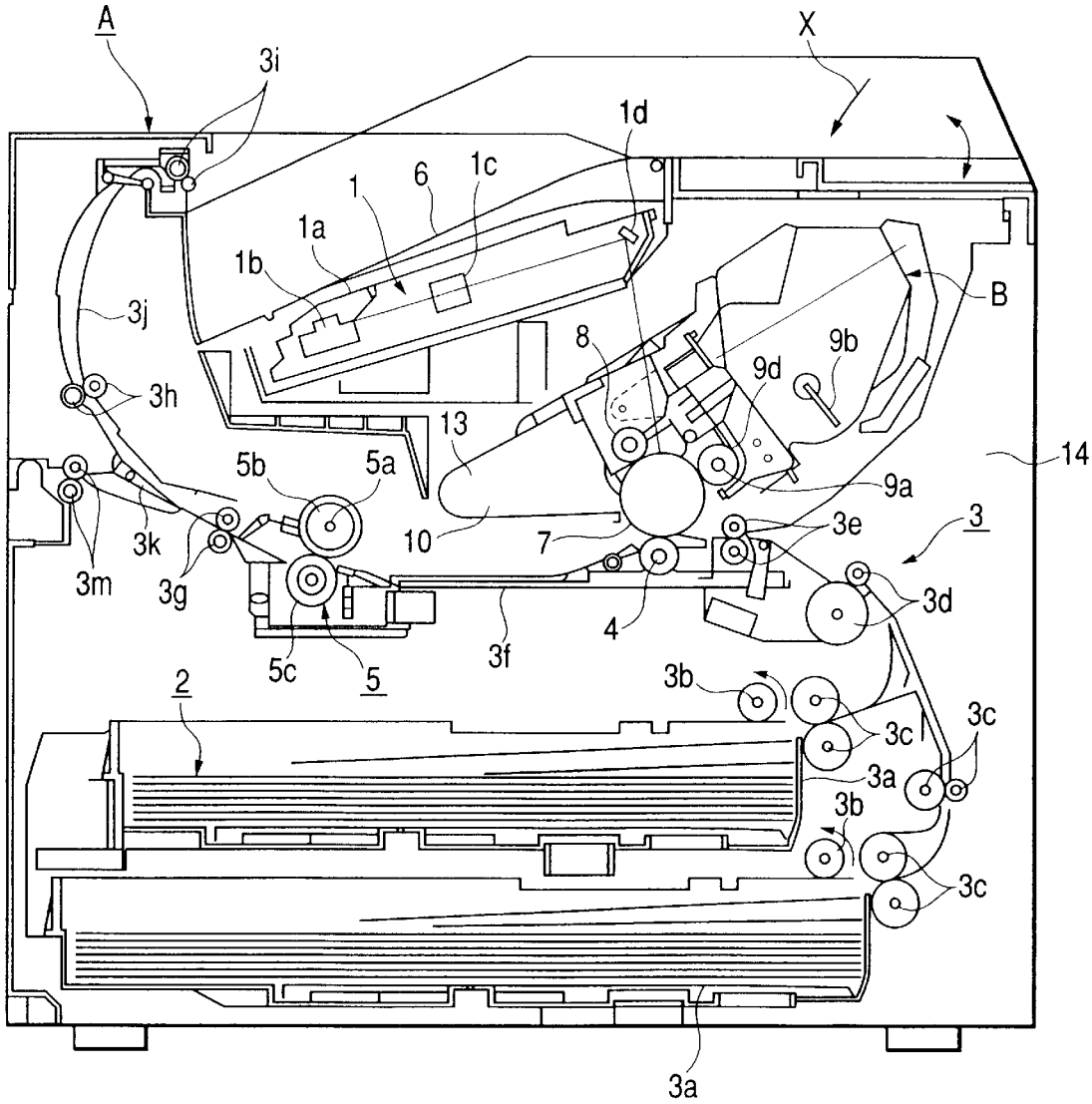
FIG. 1 is a view schematically illustrating the configuration of an embodiment of an electrophotographic image forming apparatus in accordance with the present invention.
Figure 2:
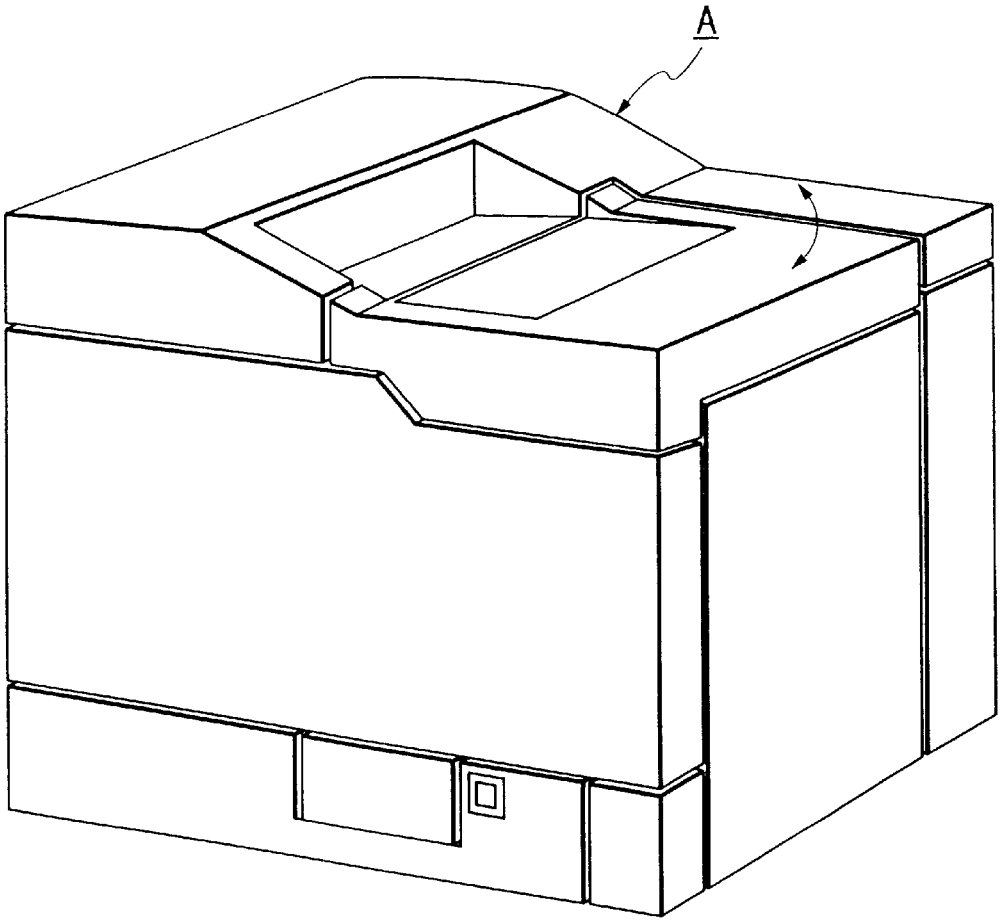
FIG. 2 is an external perspective view of an electrophotographic image forming apparatus in accordance with the present invention.

An embodiment of an electrophotographic image forming apparatus to which a process cartridge configured in accordance with the present invention is mountable will first be described with reference to FIG. 1 through FIG. 3. In this embodiment, an electrophotographic image forming apparatus is a laser beam printer A of the electrophotographic type and forms an image on a recording medium, for example, a recording paper, an OHP sheet, and cloth by an electrophotographic image forming process.

The laser beam printer A has a drum-shaped electrophotographic photosensitive member, i.e., a photosensitive drum 7. An electrostatic latent image is formed on the surface of the photosensitive drum 7 by electrostatic latent image forming means. That is, the surface of the photosensitive drum 7 is charged by a charging roller 8 being charging means and then a latent image corresponding to image information is formed on the photosensitive drum 7 by irradiating the drum 7 with a laser beam corresponding to the image information from optical means 1 having a laser diode 1*a*, a polygon mirror 1*b*, a lens 1*c* and a reflective mirror 1*d*. The latent image is developed by developing means 9 and is made a visible image, i.e., a toner image.

That is, the developing means 9 has a developing chamber 9A provided with a developing roller 9*a* as a developer bearing member and feeds developer in developer container 11A, as a developer containing portion formed adjacent to the developing chamber 9A, to the developing roller 9*a* of the developing chamber 9A, by the rotation of a developer feeding member 9*b*. In the developing chamber 9A, a developer agitating member 9*e* is provided in the vicinity of the developing roller 9*a*, which circulates the developer in the developing chamber 9A. In addition, the developing roller 9*a* incorporates a stationary magnet 9*c*, and the developer is conveyed by rotating the developing roller 9*a*, a triboelectrification charge is applied with a developing blade 9*d* and a developer layer is made with a predetermined thickness, and is supplied to a developing region of the photosensitive drum 7. The developer supplied to the developing region is transferred to the latent image on the photosensitive drum 7 and forms a toner image. The developing roller 9*a* is connected to a developing bias circuit and is usually impressed with a developing bias voltage in which alternating current is superimposed on direct current.

On the other hand, a recording medium 2 set in a sheet feed cassette 3*a* is conveyed to a transferring position by a pickup roller 3*b*, pairs of conveying rollers 3*c*, 3*d*, and a pair of registration rollers 3*e* in synchronism with the formation of a toner image. A transferring roller 4 is disposed as transferring means in the transferring position and transfers the toner image on the photosensitive drum 7 to the recording medium 2 by impressing a voltage therein.

The recording medium 2 on which the toner image has been transferred is conveyed to fixing means 5 by a conveying guide 3*f*. The fixing means 5 is provided with a driving roller 5*c* and a fixing roller 5*b* incorporating a heater 5*a*, and applies heat and pressure to the passing recording medium 2 to fix the transferred toner image on the recording medium 2.

The recording medium 2 is conveyed by pairs of discharge rollers 3*g*, 3*h* and 3*i* and is discharged to a discharge tray 6 via a sheet surface reverse path 3*j*. The discharge tray 6 is provided on the upper surface of an apparatus main body 14 of the laser beam printer A. Further, by operating a pivotably movable flapper 3*k*, the recording medium 2 can be discharged by a pair of discharge rollers 3*m* without passing through the sheet surface reverse path 3*j*. In this embodiment, the conveying means is configured by the above-mentioned pickup roller 3*b*, the pairs of conveying rollers 3*c* and 3*d*, the pairs of registration rollers 3*e*, the conveying guide 3*f*, the pair of discharge rollers 3*g*, 3*h* and 3*i* and the pair of discharge rollers 3*m*.

The photosensitive drum 7 after transferring the toner image to the recording medium 2 by the transferring roller 4 is used for the next image forming process after removing the developer remaining on the photosensitive drum 7 by cleaning means 10. The cleaning means 10 scrapes off the remaining developer on the photosensitive drum 7 by an elastic cleaning blade 10*a* provided abuttingly with the photosensitive drum 7 and collects the removed developer in a waste developer reservoir 10*b*.

Figure 3:
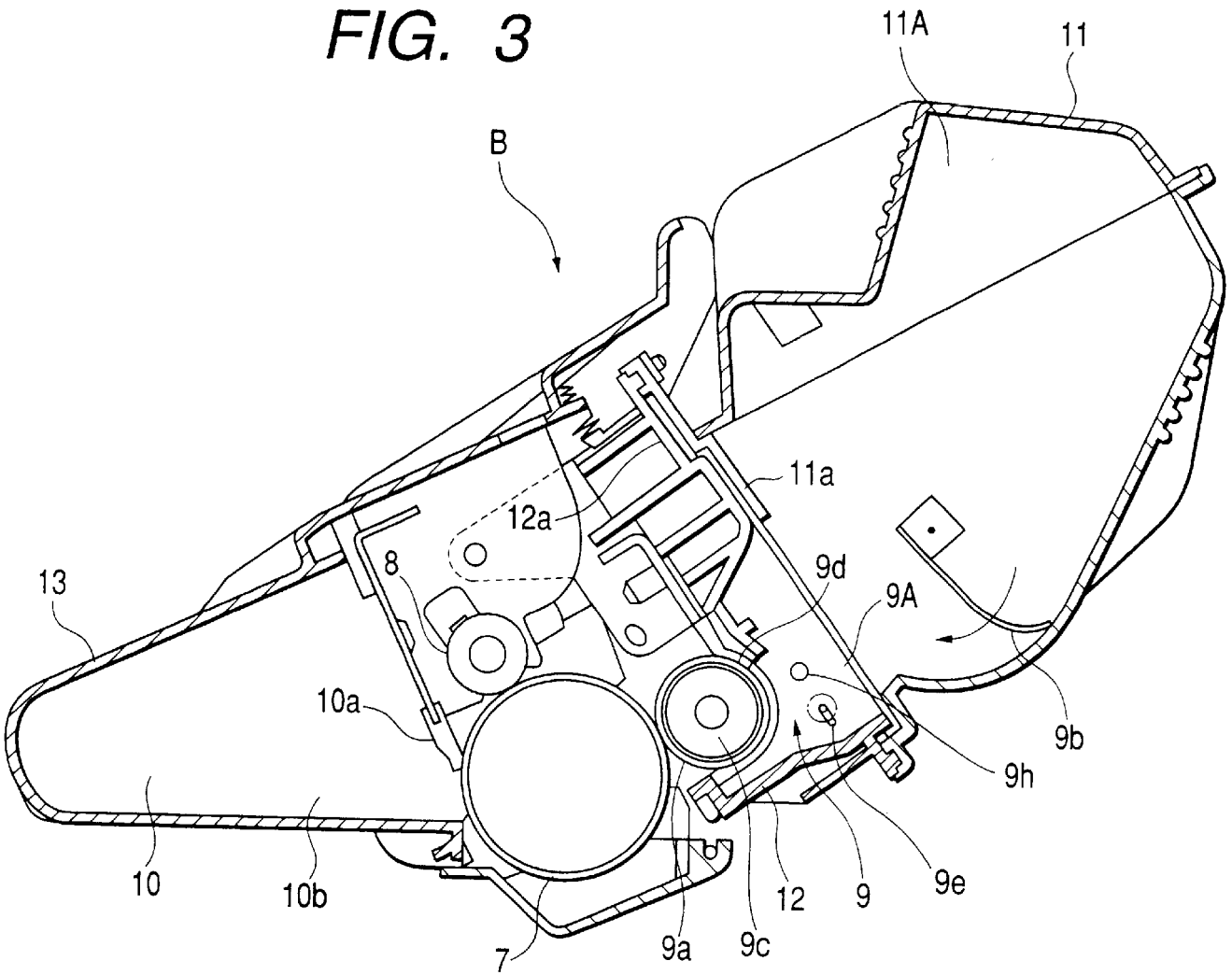
FIG. 3 is a vertical cross sectional view of an embodiment of a process cartridge in accordance with the present invention.

On the other hand, in this embodiment, as shown in FIG. 3, a process cartridge B is formed integrally by connecting a developing unit with a cleaning frame 13. The developing unit is formed by welding a developer frame 11 to a developing frame 12. The developer frame 11 has a developer container (a developer containing portion) 11A for containing developer and the developer feeding member 9*b*. The developing frame 12 holds developing means 9 such as the developing roller 9*a* and the developing blade 9*d*. The cleaning frame 13 is provided with the photosensitive drum 7, cleaning means 10 such as the cleaning blade 10*a*, and the charging roller 8.

Figure 4:
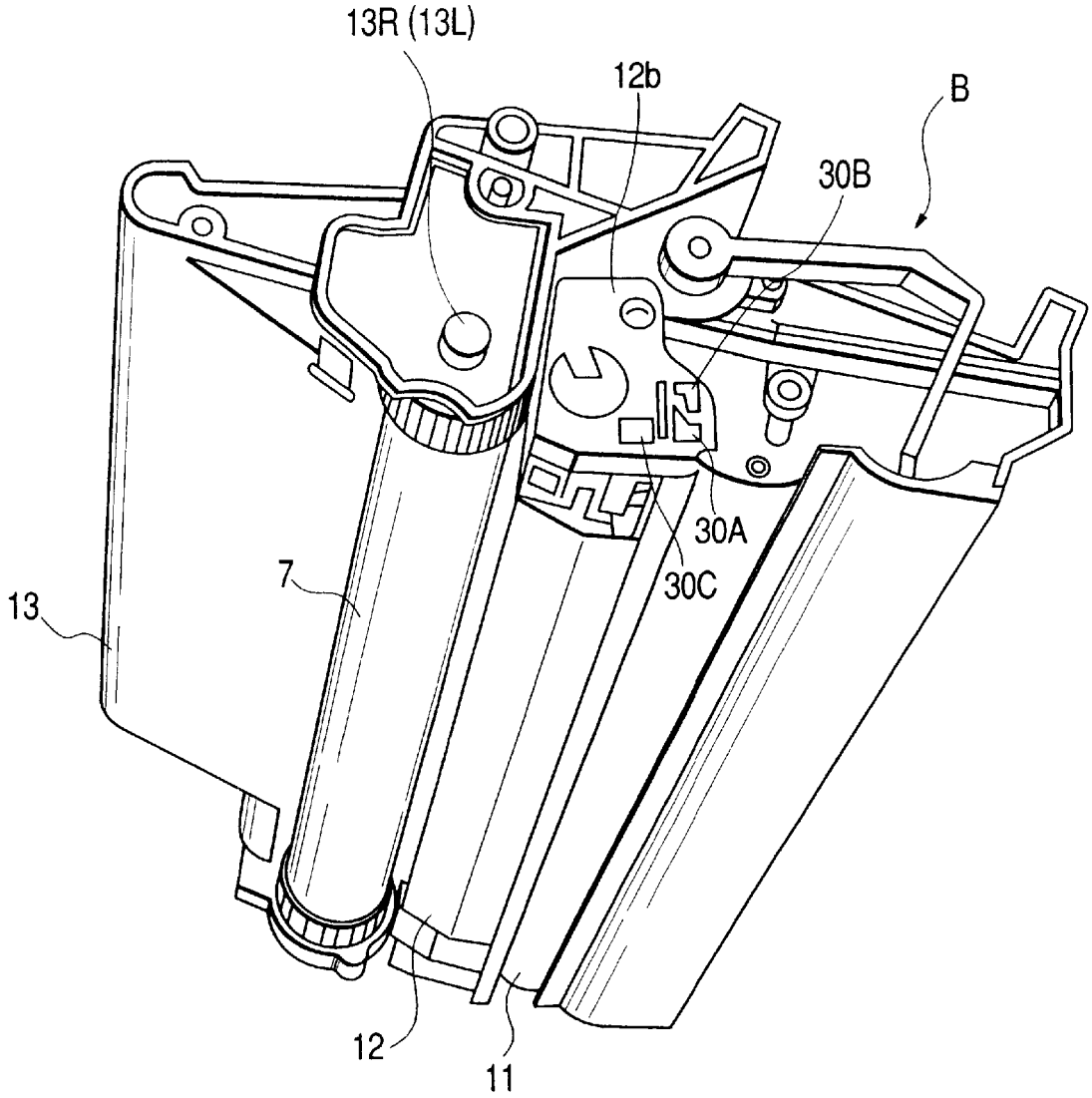
FIG. 4 is an external perspective view showing a process cartridge of the present invention viewed upward from the bottom.
Figure 5:
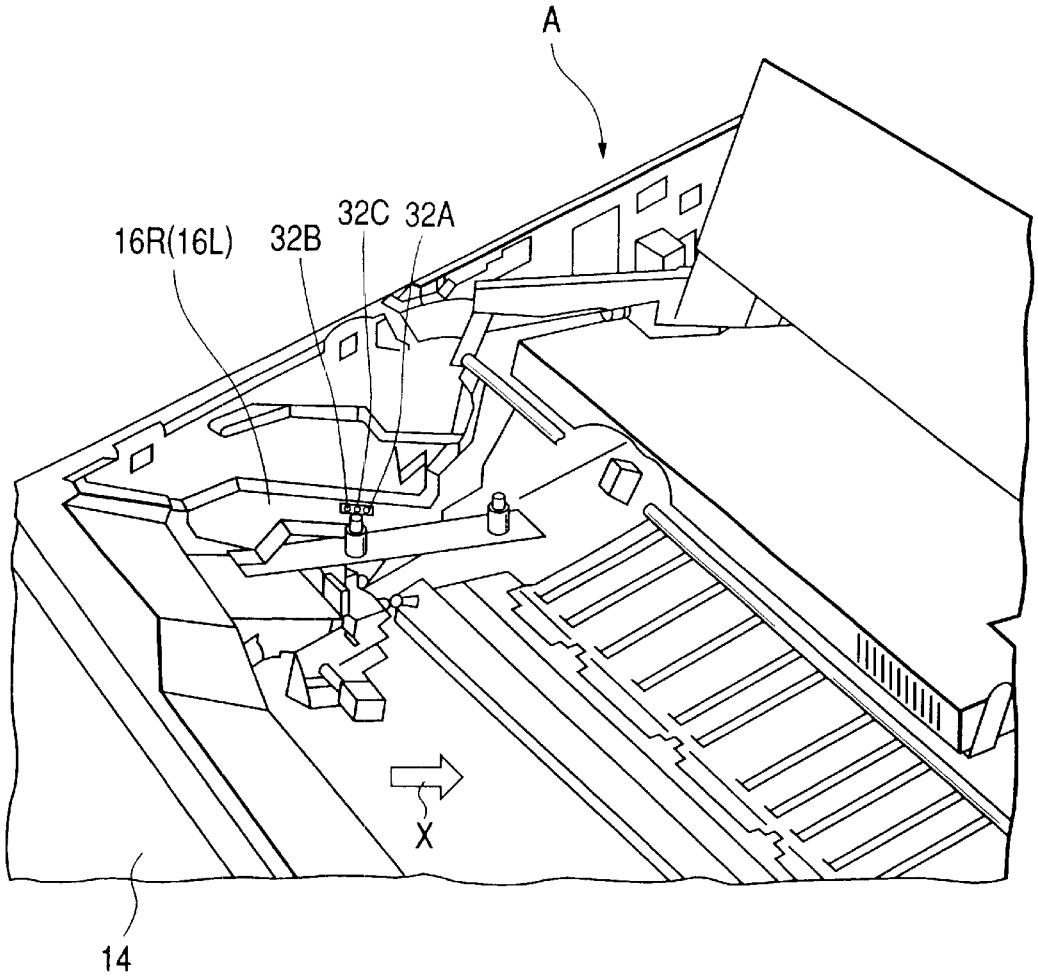
FIG. 5 is an external perspective view showing a mounting portion of an apparatus main body for mounting a process cartridge.

The process cartridge B is detachably mountable to cartridge mounting means provided in the image forming apparatus main body 14 by a user. In accordance with this embodiment, the cartridge mounting means consists of guiding means 13R (13L) formed on both the external side surfaces of the process cartridge B shown in FIG. 4 and guide portiona 16R (16L) formed in the apparatus main body 14 so that the guide means 13R (13L) can be inserted in the guide portions 16R (16L) (FIG. 5).

In accordance with the present invention, the image forming apparatus is provided with a developer amount detecting apparatus capable of successively detecting a developer remaining amount in accordance with the consumption of developer in the developer container 11A.

The principle of a developer amount detecting apparatus configured in accordance with the present invention will be first described.

Figure 6A:
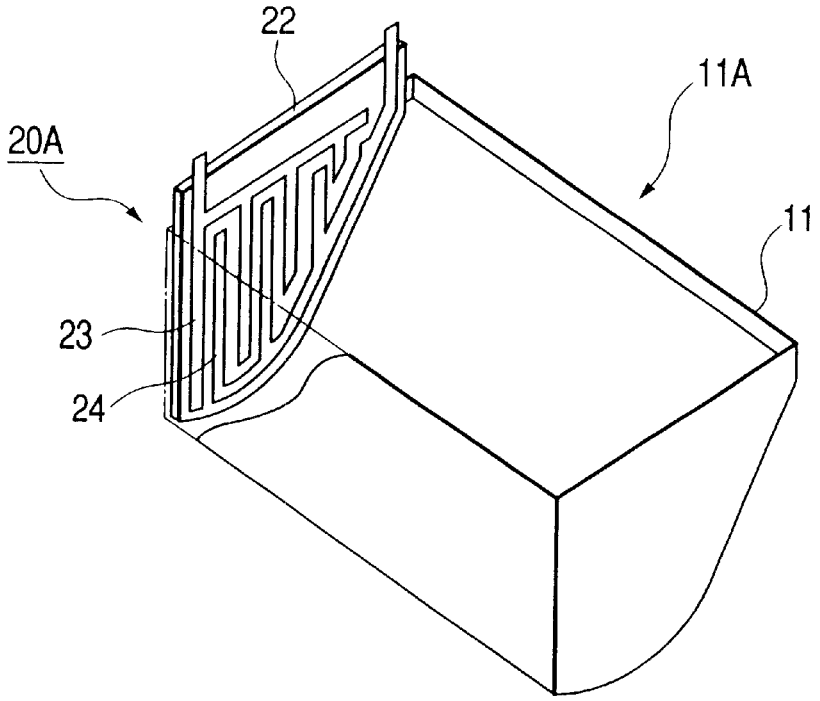
FIGS. 6A and 6B are perspective views showing a developer container and an electrode for describing the principle of a developer amount detecting apparatus, respectively.
Figure 6B:
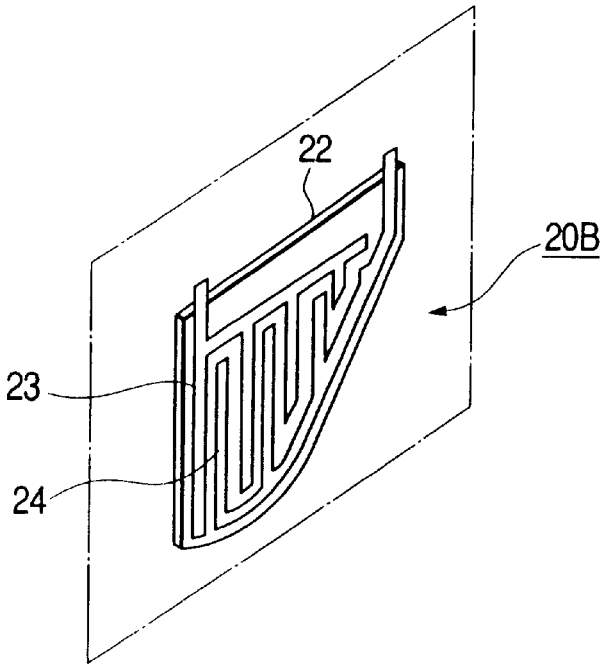

As shown in FIGS. 6A and 6B, the developer amount detecting apparatus in accordance with the present invention has a measuring electrode member 20A for measuring a developer amount as a developer amount detecting member and a reference electrode member 20B as a comparing member for detecting the environment, that is, the temperature and humidity of the atmosphere and outputting a reference signal.

Figure 13:
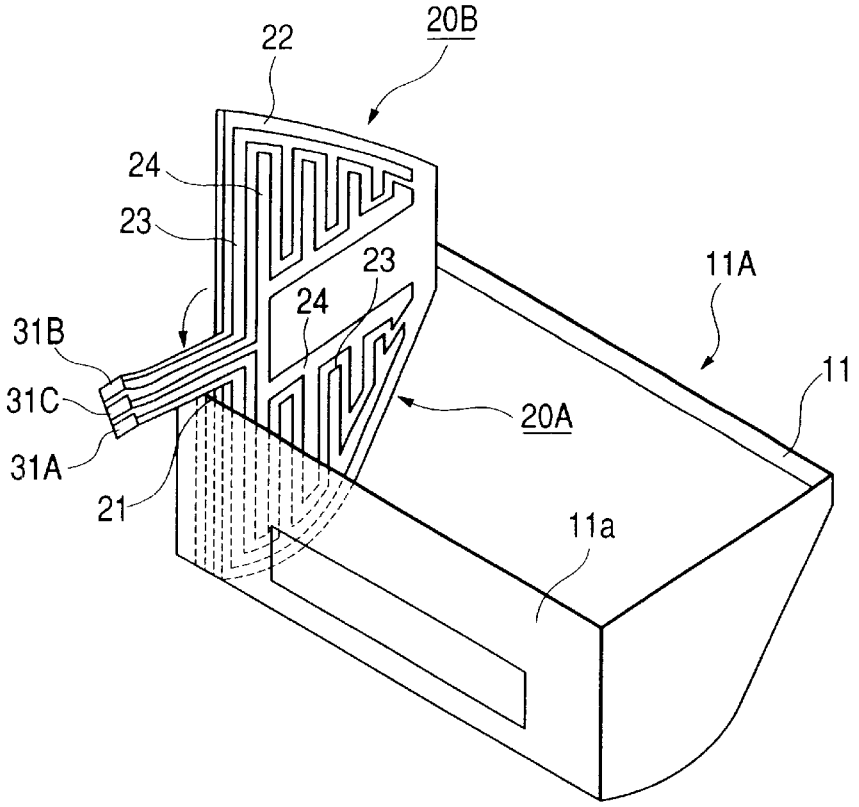
FIG. 13 is a perspective view of a developer container for illustrating an example of an arrangement of an electrode pattern in the case in which a measuring electrode member and a reference electrode member are provided in a developer container.
Figure 14:
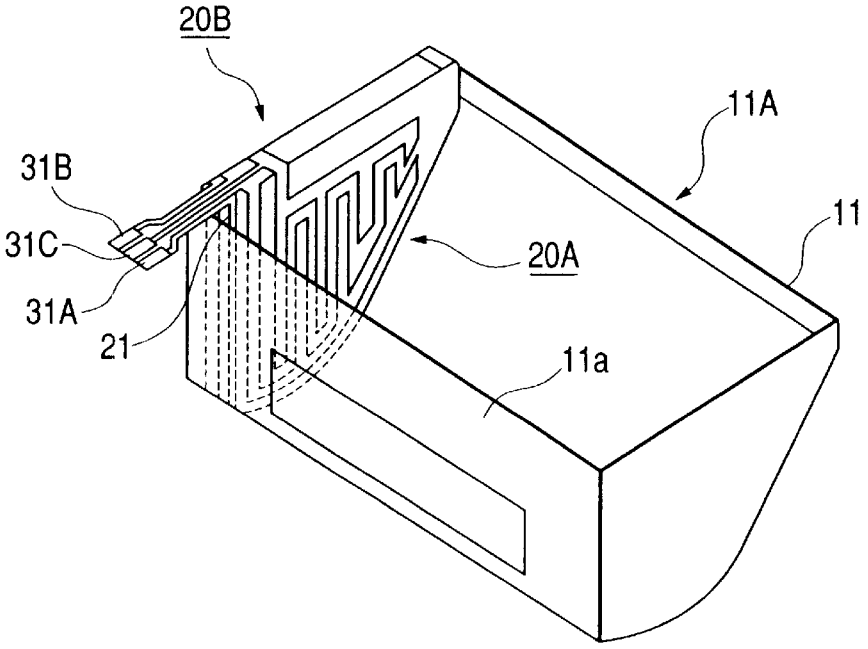
FIG. 14 is a similar view to FIG. 13, and is a perspective view of a developer container for illustrating a state in which a reference electrode member is disposed in a developer container.

As shown in FIG. 6A, the measuring electrode member 20A is disposed in a position where the measuring electrode member 20A contacts developer such as the internal side surface or the bottom surface of a developer container 11A of developing means 9, and in a direction in which a contacting area with the developer is changed as the developer decreases. In addition, as shown in FIGS. 13 and 14 and as hereinafter described more in detail, the reference electrode member 20B can be provided in a part in which the reference electrode member 20B never contacts the developer and which is divided by a partition wall 21 in the same side of the developer container as the measuring electrode member 20A is disposed.

Figure 7:
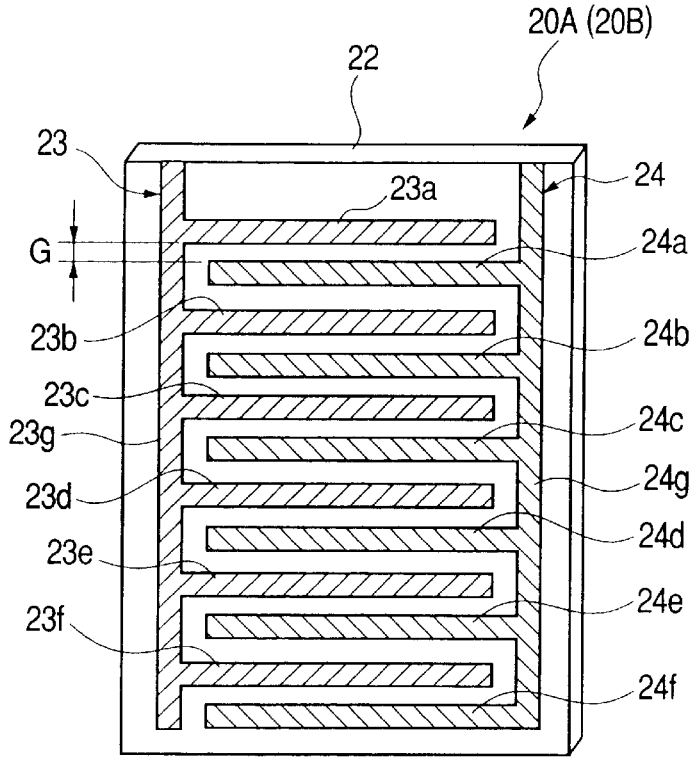
FIG. 7 is a front view schematically showing an example of an arrangement of an electrode pattern of a measuring electrode member and a reference electrode member.
Figure 8:
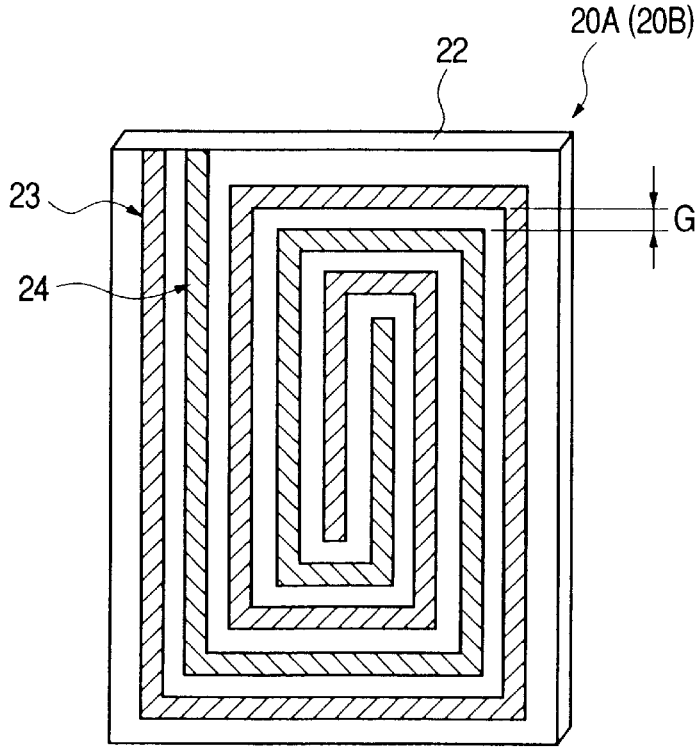
FIG. 8 is a front view schematically showing another example of an arrangement of an electrode pattern of a measuring electrode member and a reference electrode member.

The measuring electrode member 20A has a pair of electrodes formed in parallel at a predetermined interval on a substrate 22 as shown in FIG. 7, that is, an input side electrode 23 and an output side electrode 24. The electrodes 23 and 24 have at least a pair of electrode portions 23*a* through 23*f* and 24*a* through 24*f* disposed in parallel at a predetermined intervals G. Each of the electrode portions 23*a* through 23*f* and 24*a* through 24*f* are connected with each other at connecting electrode portions 23*g* and 24*g*, and two electrodes 23 and 24 are shaped in a lot of topologies being interdigitated with each other. Naturally, the electrode pattern of the measuring electrode member 20A is not limited to this, and may be formed in a swirl shape in which the pair of electrodes 23 and 24 are disposed in parallel with each other with a predetermined interval as shown in FIG. 8.

The measuring electrode member 20A can successively detect a developer remaining amount in the developer container 11A by measuring the electrostatic capacitance between the pair of parallel electrodes 23 and 24. That is, since developer has a larger dielectric constant than air, the electrostatic capacitance between the pair of electrodes 23 and 24 is increased with the developer contacting the surface of the measuring electrode member 20A.

Therefore, by using the measuring electrode member 20A with the above-mentioned configuration, a developer amount in the developer container 11A can be measured by applying a predetermined calibration curve from the area of the developer contacting the surface of the measuring electrode member 20A regardless of the shape of a cross section of the developer container 11A and the shape of the measuring electrode member 20A.

Such electrode patterns 23 and 24 of the measuring electrode member 20A can be obtained by forming conductive metal patterns 23 and 24 of copper and the like by etching or printing on a hard printed substrate 22 of, for example, paper phenol and glass epoxy with the thickness of, for example, 0.4 to 1.6 mm or on a flexible printed substrate 22 such as polyester and polyimide with a thickness of approximately 0.1 mm, and can be manufactured by a method identical with the wiring pattern forming method of a usual printed substrate. Therefore, a complicated electrode-pattern shape, such as the one shown in FIGS. 7 and 8*u*, can be easily manufactured with little increase of manufacturing costs from those of a simple pattern.

In addition, by using a complicated pattern shape as shown in FIGS. 7 and 8, the opposing length between the electrodes 23 and 24 can be made longer, and by using the pattern forming method, such as etching, an interval G between the electrodes 23 and 24 can be as narrow as several tens of $\mu$m, and therefore, a larger electrostatic capacitance can be obtained. Further, the variation amount of the electrostatic capacitance can be larger and the accuracy of detection can be increased. More concretely, the electrodes 23 and 24 have a width of 0.1 to 0.5 mm and a thickness of 17.5 to 70 $\mu$m, and have an interval G of 0.1 to 0.5 mm. Moreover, the metal pattern forming surface can be laminated with a thin resin film of, for example, approximately 12.5 to 125 $\mu$m.

As described above, the developer amount detecting apparatus measures the variation of a contacting area of developer with respect to the measuring electrode member 20A disposed in the direction in which developer on the side surface or the bottom surface inside the developer container 11A decreases, that is, the variation of electrostatic capacitance of the measuring electrode member 20A, and successively detects a developer amount of the entire developer container by the measured value.

That is, since the dielectric constant of developer is larger than that of air, a part where developer contacts the measuring electrode member 20A (where there is developer) has a larger outputted electrostatic capacitance compared with a part where developer does not contact the measuring electrode member 20A (where there is no developer). Therefore, a developer amount in the developer container 11A can be estimated if the variation of the electrostatic capacitance is measured.

In accordance with the present invention, as shown in FIG. 6B, the developer remaining amount detecting apparatus further has the reference electrode member 20B having the same configuration as that of the measuring electrode member 20A.

The reference electrode member 20B is the same as the above-mentioned measuring electrode member 20A. As shown in FIG. 7, the reference electrode member 20B has a pair of an input side electrode 23 (23*a* through 23*f*) and an output side electrode 24 (24*a* through 24*f*) disposed in parallel at the predetermined intervals G on the substrate 22 and can have a shape of a lot of topologies in which the electrodes 23 and 24 are interdigitated with each other, or can be formed in a swirl shape as shown in FIG. 8. The reference electrode member 20B as well can be manufactured by a method identical with the wiring pattern forming method of a usual printed substrate.

In accordance with the present invention, as described above, the reference electrode member 20B has an electrostatic capacitance that fluctuates depending on environmental conditions, such as temperature and humidity, and functions as a comparing member for reference with respect to the measuring electrode member 20A.

That is, an output of the measuring electrode member 20A is compared with an output of the reference electrode member 20B that fluctuates depending on a variation of the environment. For example, since only an output of a varied amount of electrostatic capacitance by developer can be obtained by setting a predetermined electrostatic capacitance of the reference electrode member 20B at a same value as that of the measuring electrode member 20A at the time when there is no developer to find the difference of outputs of the reference electrode member 20B and the measuring electrode member 20A, the accuracy of the developer remaining amountdetection can be increased.

The principle of the developer amount detection by the above-mentioned developer amount detecting apparatus will be further described. Since the measuring electrode member 20A estimates a developer amount in the developer container 11A by measuring the electrostatic capacitance of a contacting part of the pattern surface, the value fluctuates depending on a variation of the environment (such as humidity and temperature).

For example, since the amount of steam in the air increases with an increase in humidity, the dielectric constant of the atmosphere contacting the detecting member 20A also increases. Due to this reason, the output from the measuring electrode member 20A changes when the environment changes even if the developer amount remains the same. In addition, if the substrate 22 forming the pattern is made of an absorbent material, since the dielectric constant changes by moisture absorption, the output of the measuring electrode member 20A fluctuates due to the environment.

Thus, a developer remaining amount can be measured without being influenced by an environmental variation by placing the reference electrode member 20B, as a comparing member, to be subject to the same environmental variation as the measuring electrode member 20A, that is, by using a reference electrode member 20B having the same configuration as the measuring electrode member 20A and not contacting developer under the same environment as the measuring electrode member 20A and comparing both the outputs to find a difference in the outputs to eliminate the environmental variation.

As shown in the left most bar graph, the electrostatic capacitance measured from the measuring electrode member 20A, being a detecting member for detecting a developer amount, is outputted with an environmental variation portion added to a variation portion that varies due to the developer contacting the detecting member surface. Then, when it is transported to an environment with a high temperature and a high humidity, as shown in the left most bar graph of FIG. 10, since the variation portion by the developer does not change but the environmental variation portion increases, the electrostatic capacitance increases despite the identical developer amount.

Figure 9:
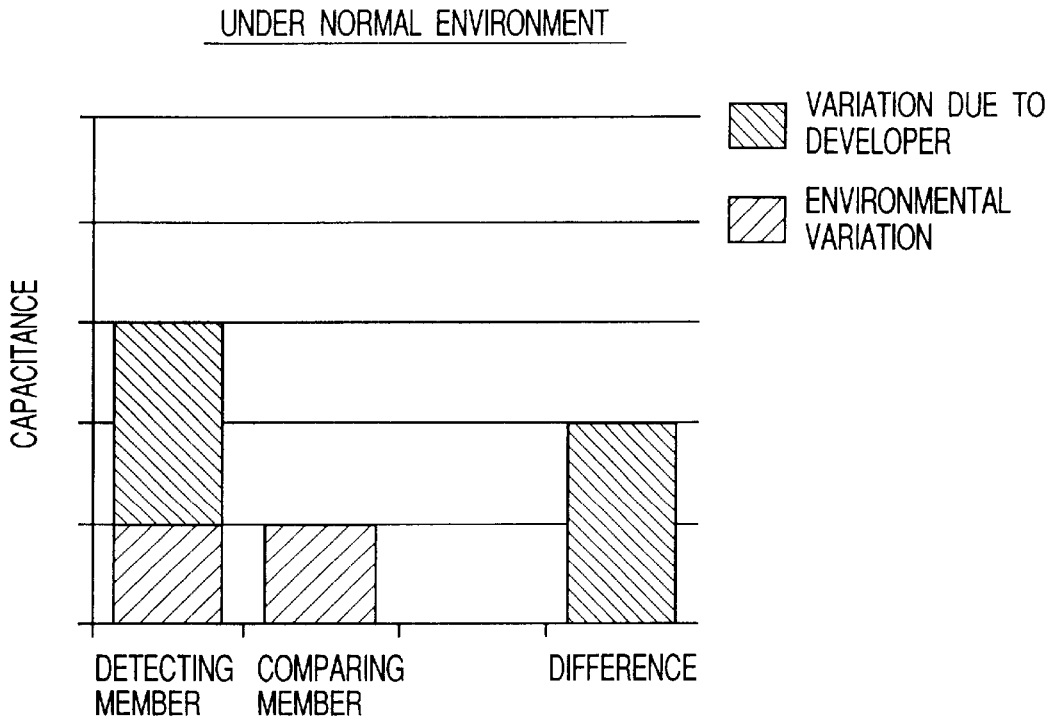
FIG. 9 is a graph for illustrating the principle of a developer amount detection by a developer amount detecting apparatus.
Figure 10:
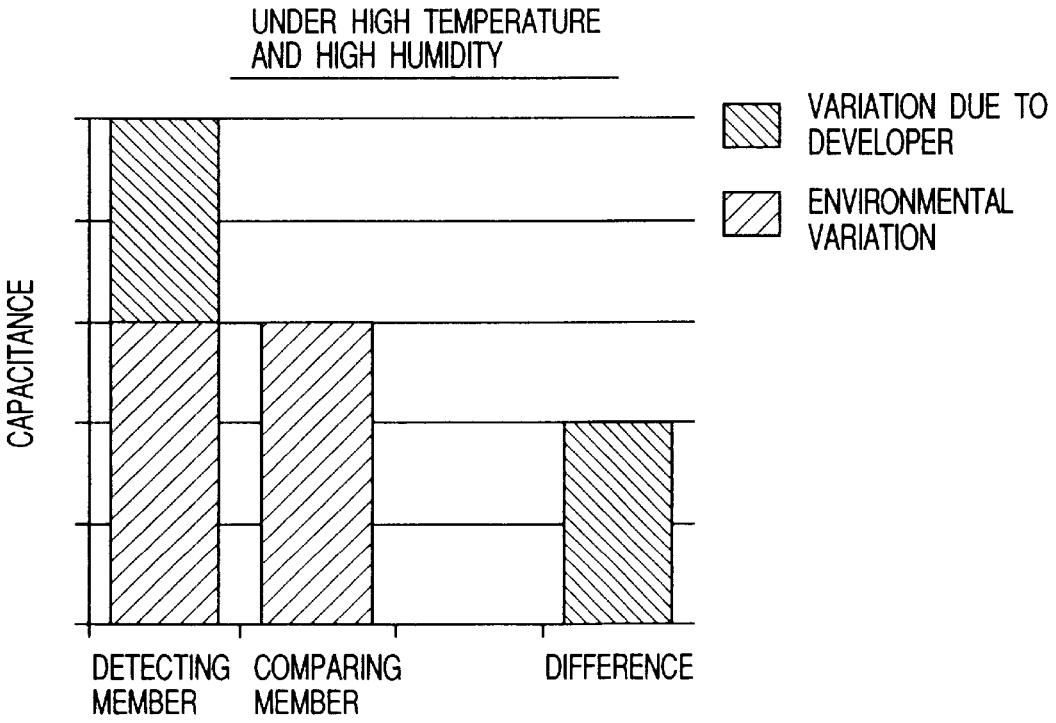
FIG. 10 is a graph for illustrating the principle of a developer amount detection by a developer amount detecting apparatus.

Thus, only an electrostatic capacitance due to the developer amount can be measured by disposing the reference electrode member (a comparing member) 20B to undergo an identical environmental variation as the measuring electrode member (a detecting member) 20A, as shown in the middle bar graphs of FIGS. 9 and 10, and finding the difference (the right bar graph).

Figure 11:
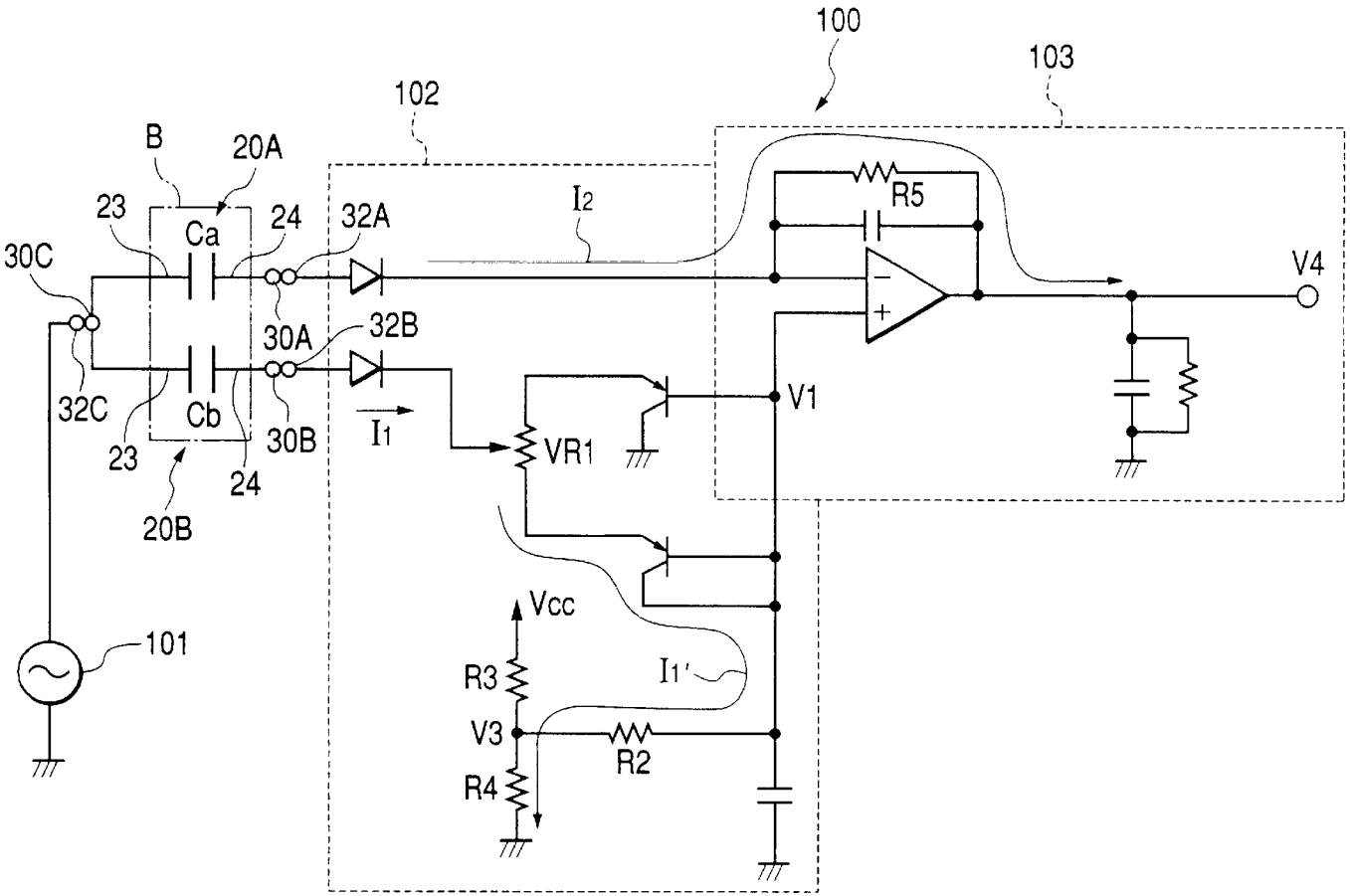
FIG. 11 illustrates an embodiment of a developer amount detecting circuit for a developer amount detecting apparatus in accordance with the present invention.

A developer amount detecting apparatus realizing such principle of developer amount detection will now be described with reference to FIG. 11. FIG. 11 shows an example of a developer amount detecting circuit, which also shows a connection state of the measuring electrode member 20A and the reference electrode member 20B in the image forming apparatus.

Each of the measuring electrode members 20A as a detecting member that has an electrostatic capacitance Ca fluctuating in accordance with a developer amount and the reference electrode member 20B as a comparing member that has an electrostatic capacitance Cb fluctuating in accordance with environmental conditions, as an impedance element, has one of its input side electrodes 23 connected to a developing bias circuit 101, being developing bias impressing means as voltage impressing means via a contact 30C (an apparatus main body side contact 32C) and the other output side electrode 24 connected to a control circuit 102 of a developer amount detecting circuit 100 via contacts 30A (an apparatus main body side contact 32A) and 30B (an apparatus main body side contact 32B). The reference electrode member 20B sets a reference voltage V1 in detecting a developer remaining amount using AC (alternating) current $I_1$ impressed via the developing bias circuit 101.

As shown in FIG. 11, the control circuit 102 determines the reference voltage V1 by adding a voltage drop portion V2, caused by AC current $I_1'$ being a value calculated by splitting AC current $I_1$ impressed on the reference electrode member 20B, i.e., an impedance element, by a volume VR1 and a resistance R2, to a voltage V3 set by resistances R3 and R4.

Therefore, AC (alternating) current $I_2$ impressed on the measuring electrode member 20A is inputted in an amplifier 103 and outputted as a detection value V4 ($V1-I_2 \times R5$) of a developer remaining amount. The output value is utilized as a detection value of the developer remaining amount.

As described above, since the reference electrode member 20B whose capacitance fluctuates by the environment as in the measuring electrode member 20A is provided as a comparing member, the variation of the measuring electrode member 20A by the environment can be canceled and a developer remaining amount can be detected with high accuracy.

Figure 12:
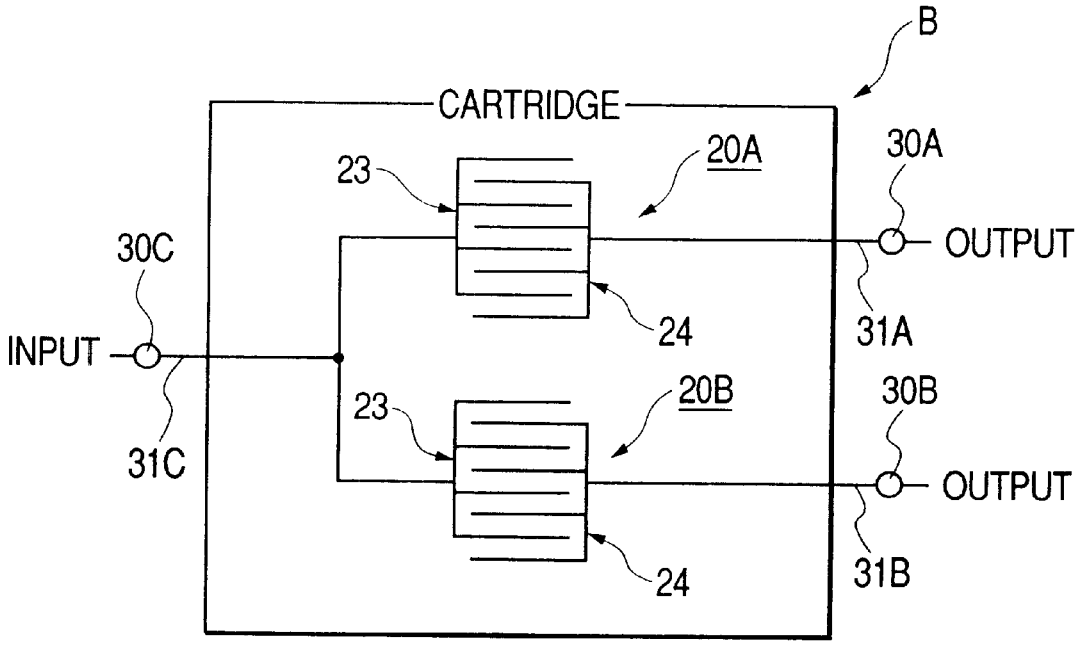
FIG. 12 is a view schematically illustrating an arrangement and configuration of a measuring electrode member and a reference electrode member.

For example, as shown in FIGS. 12 through 14, the measuring electrode member 20A and the reference electrode member 20B having the same configuration as the measuring electrode member 20A as a reference can be disposed in the developer container 11A. With this configuration, since the developer container has the measuring electrode member 20A and the reference electrode member 20B, fluctuation by the environment can be canceled and, at the same time, since the measuring electrode member 20A and the reference electrode member 20B can be placed under substantially the same environment, the accuracy of detection can be increased.

Moreover, as shown in FIGS. 11 and 12, the developer amount detecting apparatus can have a configuration provided with a total of three contacts in the process cartridge B, namely, a contact 30C for input commonly used for detection and comparison and contacts 30A and 30C for detection and comparison/output. With this configuration, the number of parts of a contact portion can be decreased and reduction of costs can be attained. In addition, input pulses can be the same by sharing an inputting signal, which increases the accuracy.

To explain further, as would be appreciated with reference to FIGS. 13 and 14, the measuring electrode member 20A and the reference electrode member 20B have electrodes 23 and 24 respectively formed on one side of a flexible substrate 22, such as a flexible printed substrate, and can be disposed in the developer container by being folded down. In addition, the measuring electrode member 20A and the reference electrode member 20B can be the same electrode pattern and, in that case, patterns of both the electrodes 23 and 24 of the measuring electrode member 20A and the reference electrode member 20B have substantially equal electrostatic capacitance and have a shape with substantially the same width, length, interval and opposing areas. The reference electrode member 20B manufactured in this way is folded down in substantially the middle of the substrate and is disposed in a part not contacting developer and divided by the partition wall 21 inside the developer container 11A in which the measuring electrode member 20A is disposed.

As described above, the measuring electrode member 20A and the reference electrode member 20B are manufactured in the same manner as in the usual printed substrate manufacturing process and, therefore, dispersion in electrostatic capacitance of the substrate arises due to dispersion of the absorbency and the dielectric constant of a substrate material, as well as dispersion of the electrode pattern width and height due to the difference in etching conditions. Thus, if the measuring electrode member 20A and the reference electrode member 20B are formed on one surface of the substrate and one piece of the substrate serves as a detecting member and a comparing member, the one piece of the substrate is sufficient and costs can be lowered. In addition, since electrode patterns are formed on materials of one set of characteristics, dispersion by the difference in substrates can be controlled and further, since the patterns are formed on the same surface, dispersion at the time of a pattern formation, such as etching, can be controlled. Moreover, with the above-mentioned configuration, since detecting patterns can be disposed to the upper part of the developer container, a developer amount can be measured from the state in which developer is substantially full in the developer container.

As shown in FIG. 13, in the case in which the measuring electrode member 20A and the reference electrode member 20B are formed on the one surface of the substrate 22, an output terminal 31A for a measuring electrode electrically connected to the output side electrode 24 of the measuring electrode member 20A, an output terminal 31B for a reference electrode electrically connected to the output side electrode 24 of the reference electrode member 20B, and a common input terminal 31C connected to the input side electrodes 23 of the measuring electrode member 20A and the reference electrode member 20B, extend from the substrate 22.

Figure 15:
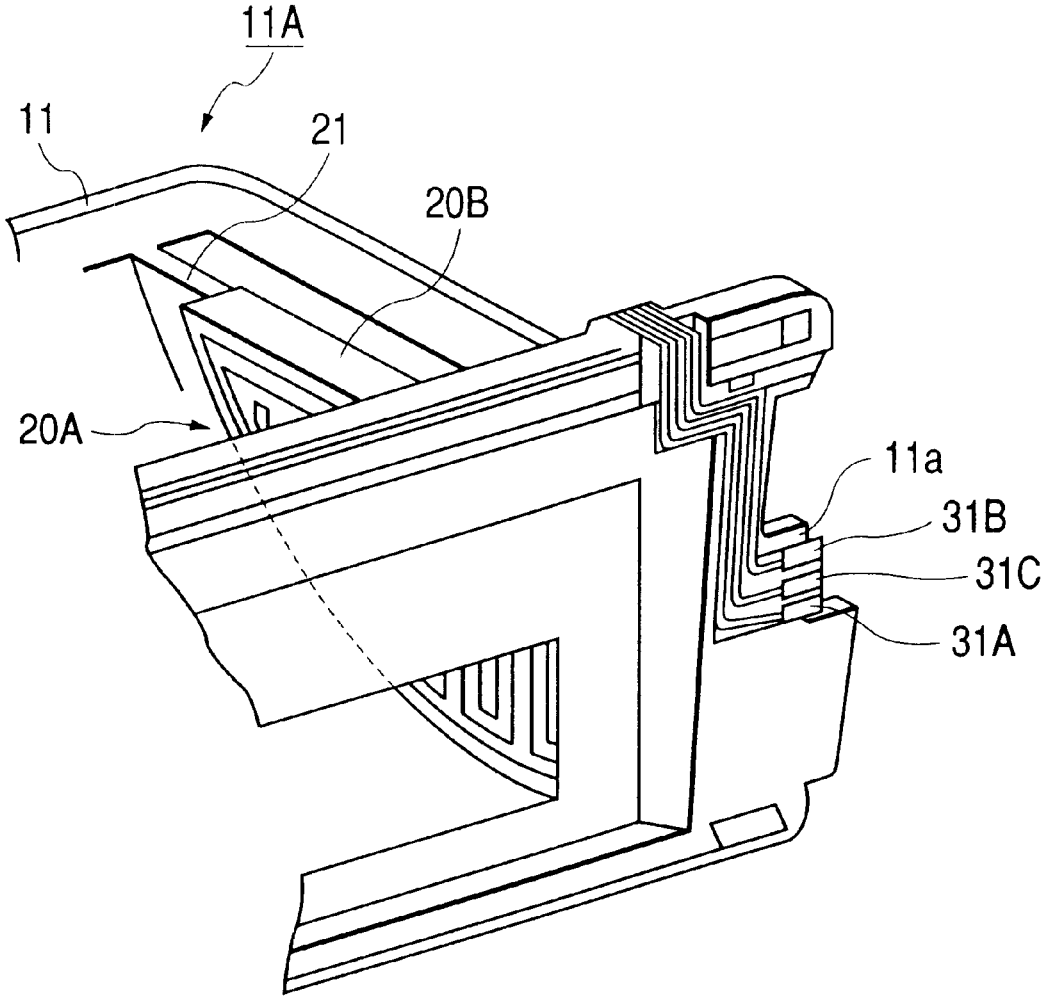
FIG. 15 is a view schematically illustrating a state of connection of terminals of a measuring electrode member and a reference electrode member.
Figure 16:
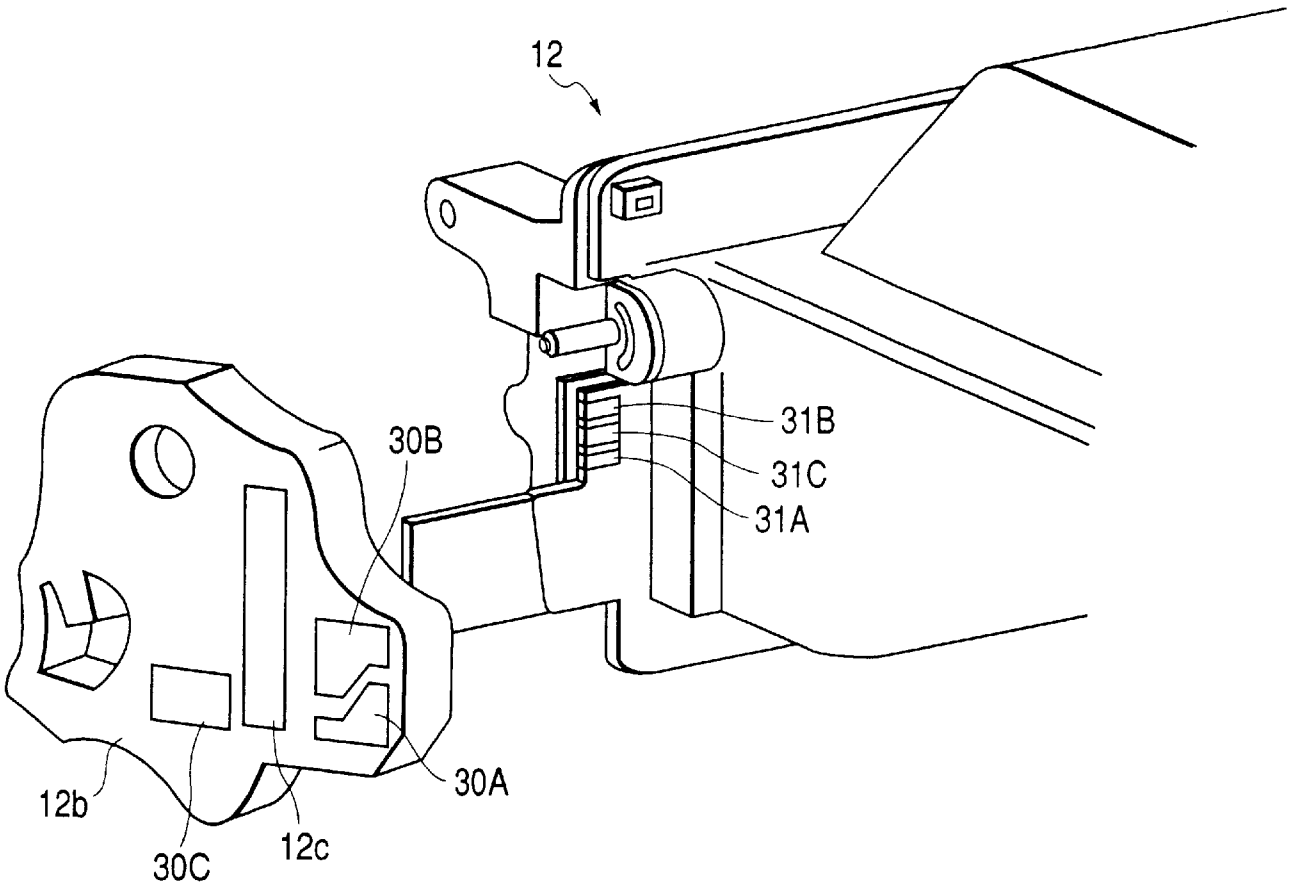
FIG. 16 is a view schematically illustrating three contacts provided in a process cartridge.

As shown in FIG. 15 for example, these three terminals 31A, 31B and 31C cross over a welded fixing portion with a developer frame 12 (FIG. 16) of the developer container 11A and are fixed to a front wall portion 11*a* of the developer frame 11. Further, as would be appreciated with reference to FIGS. 16 and 4 as well, the three terminals 31A, 31B and 31C are exposed outwardly from a contact window 12 formed in a side member 12*b* fixed to the side portion of the developer frame 12, and are electrically connected to the output contact 30A for a measuring electrode, the output contact 30B for a reference electrode and the common input contact 30C attached to the side member 12*b*. As shown in FIG. 5, the contacts 30A, 30B and 30C of this process cartridge are electrically connected to the contacts 32A, 32B and 32C disposed in the apparatus main body 14 when the process cartridge B is mounted in the apparatus main body 14 and, therefore, the measuring electrode member 20A and the reference electrode member 20 B disposed in the process cartridge B are connected to the developer amount measuring circuit 100 shown in FIG. 11.

Further, as described above, by electrically connecting the input side electrodes 23 of the measuring electrode member 20A and the reference electrode member 20B to the common input contact 30C provided in the process cartridge and the common contact 32C provided in the apparatus main body 14, although there are such advantages that costs of manufacturing can be reduced and input pulses can be the same, connection of the developer amount detecting apparatus is not limited to this and the input side electrodes 23 of the measuring electrode member 20A and the reference electrode member 20B may be electrically connected to the developing bias circuit 101 via respective contacts. In addition, as hereinafter described in detail, if the reference electrode member 20B is provided in the image forming apparatus main body 14, the input side electrode 23 of the measuring electrode member 20A is connected to the contact 32C of the apparatus main body 14 via the input contact 30C provided in the process cartridge, but the input side electrode 23 of the reference electrode member 20B is directly connected to the contact 32C of the apparatus main body 14.

In the above description of the principle of the developer amount detection by the developer amount detecting apparatus, the patterns of both the electrodes 23 and 24 of the measuring electrode member 20A and the reference electrode member 20B are described as having substantially the same electrostatic capacitance and being formed in a shape with substantially the same pattern width, length, interval and opposing areas, but it is also possible to make the electrostatic capacitance of the reference electrode member 20B for comparison different from electrostatic capacitance of the measuring electrode member 20A, which is found to have a lot of advantages as hereinafter described.

The developer amount detecting apparatus of the present invention that has a different electrostatic capacitance generated by the measuring electrode member 20A and the reference electrode member 20B when voltage is impressed will now be described.

Figure 17A:
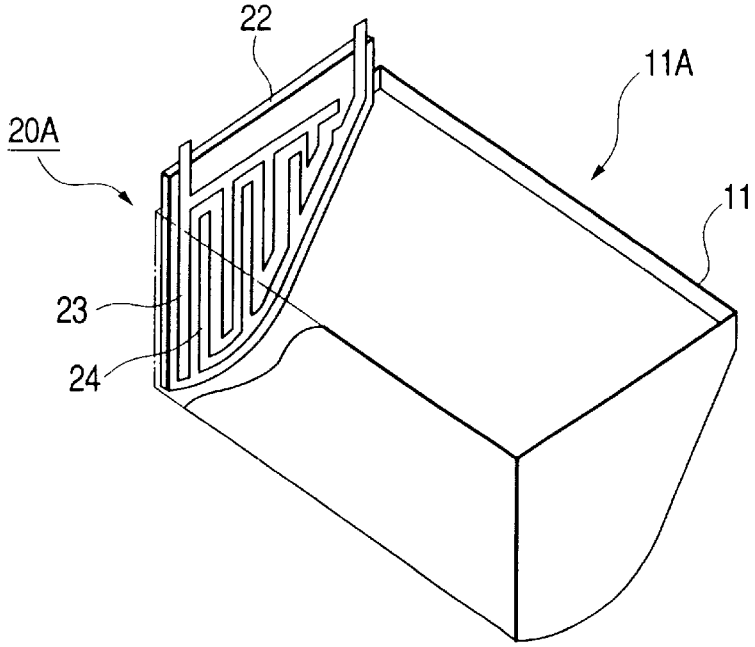
FIGS. 17A and 17B are perspective views showing a developer container and an electrode member of an embodiment of a developer amount detecting apparatus in accordance with the present invention, respectively.
Figure 17B:
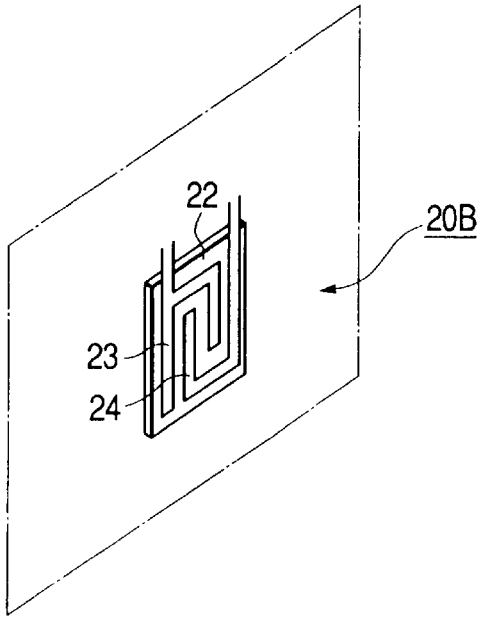

FIGS. 17A and 17B show an embodiment of the developer amount measuring apparatus that has different electrostatic capacitances generated by the measuring electrode member 20A and the reference electrode member 20B. As shown in FIGS. 17A and 17B, in accordance with the present invention, the areas of the electrode patterns are set to be relatively larger in the measuring electrode member 20A and smaller in the reference electrode member 20B. In the embodiment shown in FIGS. 17A and 17B, the reference electrode member 20B and the measuring electrode member 20A are made to have substantially equal pattern widths and pattern intervals of the electrode patterns but opposing areas and electrostatic capacitance of the electrode patterns are different.

Figure 18:
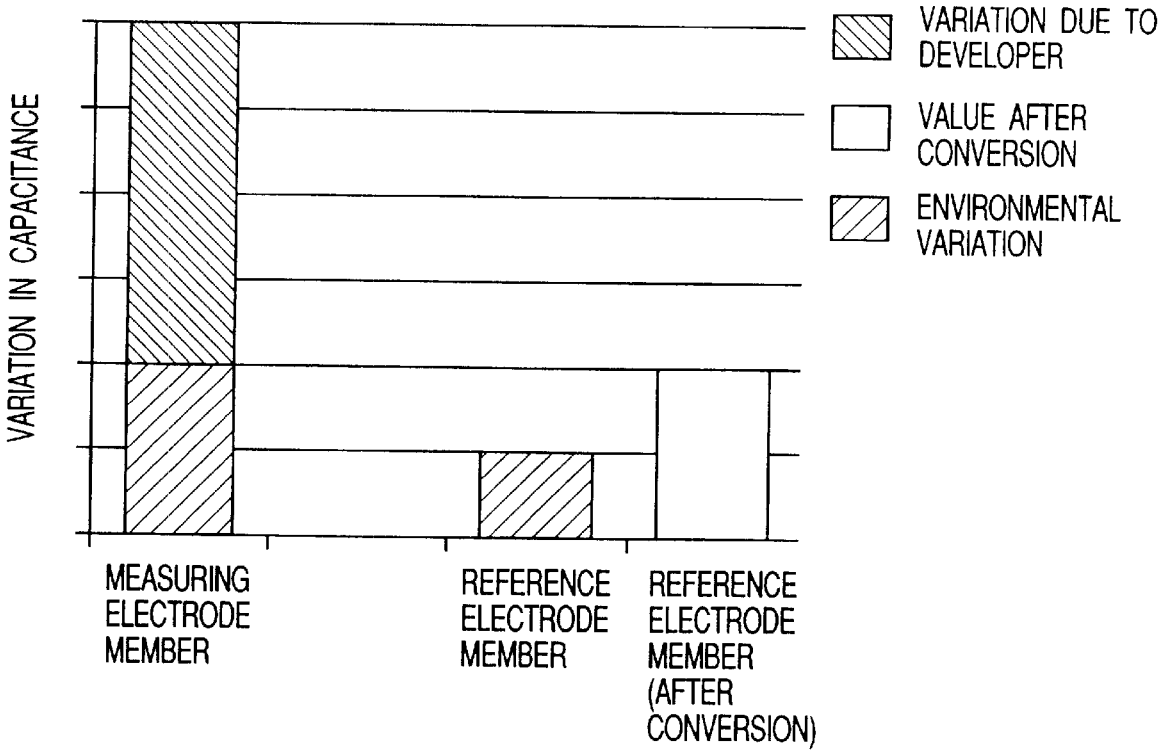
FIG. 18 is a graph for illustrating the principle of a developer amount detection in accordance with the present invention.

FIG. 18 is a graph showing the variation of electrostatic capacitance of the measuring electrode member 20A and the reference electrode member 20B configured to have different electrostatic capacitances generated when voltage is impressed. The measuring electrode member 20A and the reference electrode member 20B have different variations in electrostatic capacitance due to the environment. That is, since the measuring electrode member 20A has a larger area, the variation of electrostatic capacitance due to the environment is large and, since the reference electrode member 20B has a smaller area, the variation of electrostatic capacitance due to the environment is small.

In this case, since the values of electrostatic capacitance of the measuring electrode member 20A and the reference electrode member 20B are proportional to the areas of the electrode patterns, if the reference electrode member 20B is relatively smaller than the measuring electrode member 20A, the environmental variation portion of electrostatic capacitance is smaller in the reference electrode member 20B as shown in the middle bar graph of FIG. 18.

Thus, an output of the reference electrode member 20B is converted to a value that is calculated by multiplying the output by a predetermined factor, that is, (the electrode pattern area of the measuring electrode member 20A)/(the electrode pattern area of the reference electrode member 20B). The value after conversion is regarded as equal to the environmental variation value of the measuring electrode member 20A as shown in the right side bar graph of FIG. 18 and is compared with the output of the measuring electrode member 20A. Then, only a variation of the electrostatic capacitance by the developer can be extracted by finding the difference between the output of the measuring electrode member 20A and the output of the reference electrode member 20B after conversion.

In accordance with the present invention, with such a configuration, the reference electrode member 20B can be smaller and a small space for the developer amount detecting apparatus is sufficient.

Figure 19A:
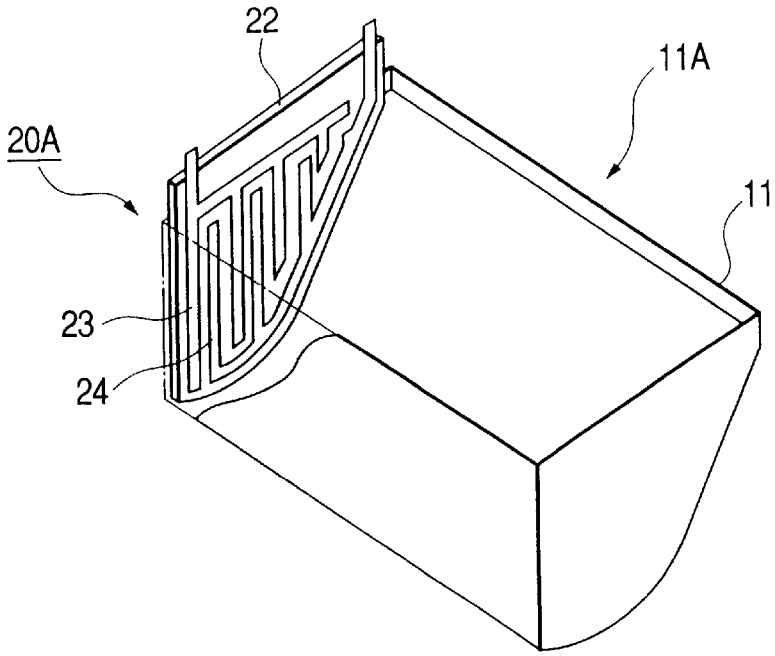
FIGS. 19A and 19B are perspective views showing a developer container and an electrode member of another embodiment of a developer detecting apparatus in accordance with the present invention.
Figure 19B:
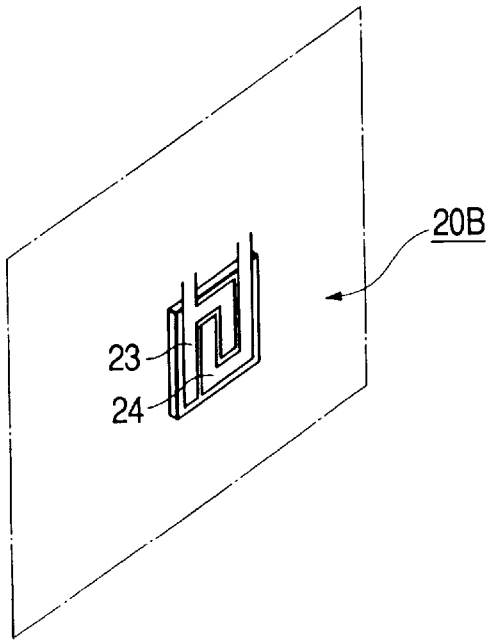

In addition, in accordance with the present invention, the electrode pattern area of the reference electrode member 20B may be smaller than that of the measuring electrode member 20A, and the pattern widths and intervals of the electrode patterns may be different. As shown in FIGS. 19A and 19B for example, the electrode pattern area of the reference electrode member 20B can be further made smaller by such a configuration as to widening the pattern width of the reference electrode member 20B and narrowing the pattern interval. In this case, since the factor multiplied by the output of the reference electrode member 20B is different by pattern width and interval, in order to successively detect a developer remaining amount, a value obtained by multiplying the output of the reference electrode member 20B by an appropriate factor depending on the shape of the reference electrode member 20B, is compared with an output of the measuring electrode member 20A.

As a space for placing the developer amount measuring apparatus, since at least an installation plane with the size of the measuring electrode member 20A and the reference electrode member 20B is necessary, the smaller the installation plane of the reference electrode member 20B becomes, the fewer the limitations on the place to dispose the developer amount measuring apparatus.

That is, by making the area of the installation plane of the reference electrode member 20B small in accordance with the present invention, the developer container 11A can be miniaturized if the reference electrode member 20B is disposed in the developer container 11A.

Figure 20:
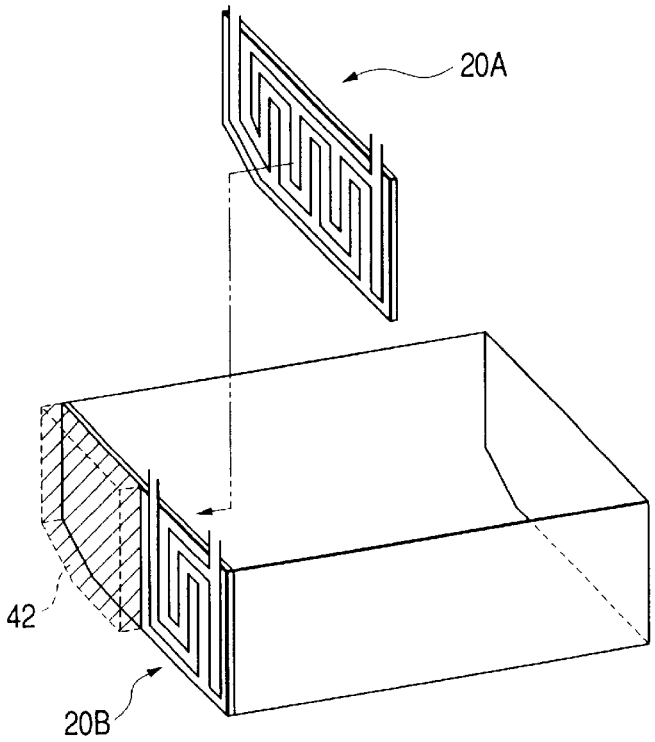
FIG. 20 is a perspective view of a developer container for illustrating an example of an arrangement in the case in which a measuring electrode member and a reference electrode member are disposed in the developer container of the present invention.
Figure 21:
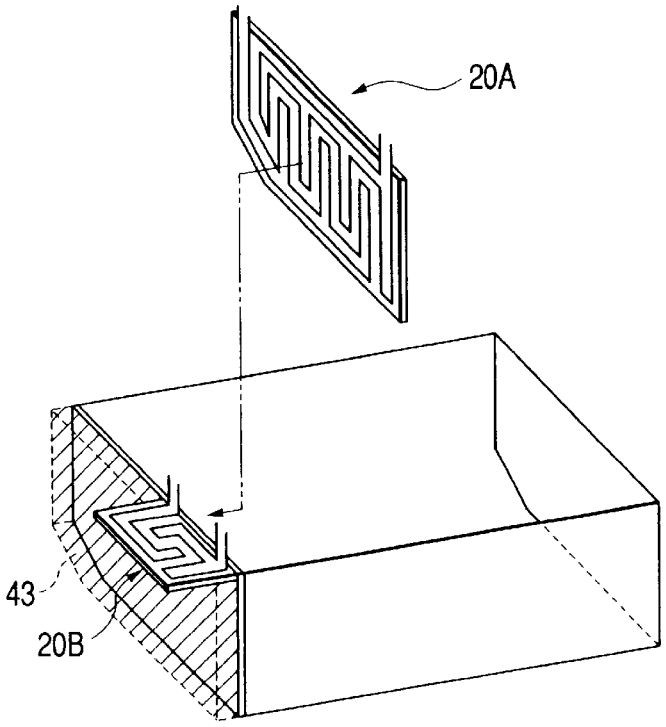
FIG. 21 is a perspective view of a developer container for illustrating another example of an arrangement in the case in which a measuring electrode member and a reference electrode member are disposed in the developer container of the present invention.

In the case in which the reference electrode member 20B is provided in the developer container 11A, for example, as shown in FIG. 20, if the reference electrode member 20B is disposed in the external side surface of the developer container 11A, that is, the other side of the wall surface of the developer container 11A on which the measuring electrode member 20A is provided, a space such as an oblique line portion 42 shown in FIG. 20, where the reference electrode member 20B does not exist, can be provided by making the electrode pattern area of the reference electrode member 20B smaller than the electrode pattern area of the measuring electrode member 20A, that is substantially equal to the area of the side surface of the developer container 11A. In addition, as shown in FIG. 21, a space, such as an oblique line portion 43 shown in FIG. 21, can be provided by providing the reference electrode member 20B that has the electrode pattern area smaller than that of the measuring electrode member 20A on the upper edge of the side surface of the side where the measuring electrode member 20A of the developer container 11 is provided and along a direction perpendicular to the side surface. Therefore, in FIGS. 20 and 21, the developer container 11A can be miniaturized by the space of the oblique line portion 42 or 43.

Figure 22:
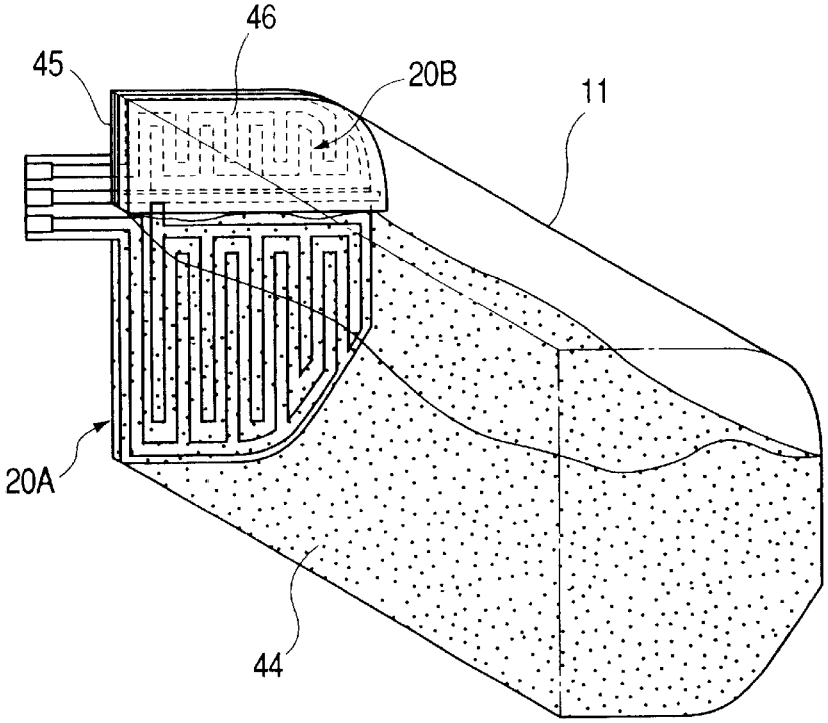
FIG. 22 is a perspective view of a developer container for illustrating an example of an arrangement in the case in which a measuring electrode member and a reference electrode member are disposed on one plane of the developer container of the present invention.
Figure 23:
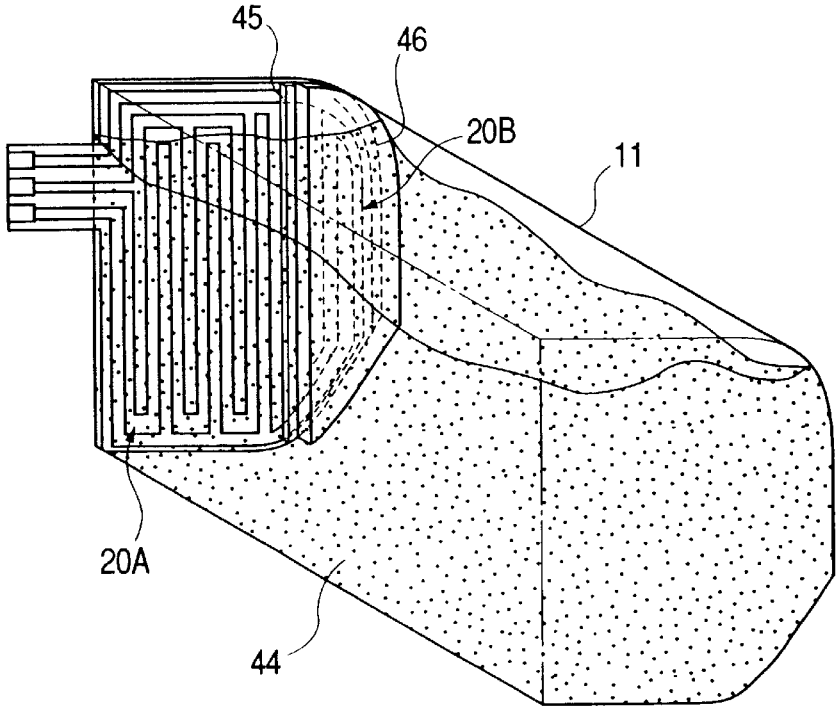
FIG. 23 is a perspective view of a developer container for illustrating another example of an arrangement in the case in which a measuring electrode member and a reference electrode member are disposed on one plane in the developer container of the present invention.

Moreover, if the reference electrode member 20B is provided in the developer container 11A, as another form of disposing the measuring electrode member 20A and the reference electrode member 20B, the measuring electrode member 20A and the reference electrode member 20B can be configured such that, as shown in FIGS. 22 and 23, both the electrode members 20A and 20B are provided on one wall surface of the same side in the developer container and the reference electrode member 20B is partitioned not to contact the developer.

As shown in FIG. 22, the reference electrode member 20B can be first disposed in the position that is the upper side part of the side surface on which the measuring electrode member 20A in the developer container is disposed and where the reference electrode member 20B does not contact the developer by being partitioned by a partition plate 46 having a developer seal member 45 for preventing the developer from entering stuck around its circumference, abutting the surface of the reference electrode member 20B. Moreover, the measuring electrode member 20A and the reference electrode member 20B are configured such that the electrode pattern area of the measuring electrode member 20A is relatively larger and the electrode pattern area of the reference electrode member 20B is relatively smaller. With such a configuration, a change in electrostatic capacitance, being a difference between the measuring electrode member 20A and the reference electrode member 20B, starts when the developer is consumed and decreased to the level that the electrode pattern portion of the measuring electrode member 20A emerges above the upper surface of the developer, and the change continues until the developer is almost fully depleted from the developer container 11A.

In addition, as shown in FIG. 23, the measuring electrode member 20A and the reference electrode member 20B are divided into the left and the right and are disposed on one wall surface of the same side in the developer container. The reference electrode member 20B is partitioned by a partition plate 46 having a developer seal member 45 for preventing the developer from entering stuck around its circumference, abutting the surface of the reference electrode member 20B as described above, so that the reference electrode member 20B is out of contact with the developer. With such a configuration, successive detection of a developer amount becomes possible from the time when there remains more developer.

When the developer container 11A cannot be extended in the longitudinal direction due to the limitation of a space and the like, it is preferable to dispose the measuring electrode member 20A and the reference electrode member 20B on one wall surface in the developer container and, as shown in FIGS. 22 and 23, for example, the measuring electrode member 20A and the reference electrode member 20B are divided within the limited areas on one side surface in the developer container. In this case, as described above, an electrode pattern ratio of the measuring electrode member 20A within the limited area can be larger by making the electrode pattern area of the reference electrode member 20B relatively smaller than the electrode pattern area of the measuring electrode member 20A, and it becomes possible to increase the detection accuracy of a developer remaining amount by making a variation amount of electrostatic capacitance larger.

Further, if the reference electrode member 20B is provided in the developer container 11A, as described above as the principle of the developer amount detection of the developer amount detecting apparatus in accordance with the present invention, it is possible and preferable that the measuring electrode member 20A and the reference electrode member 20B have electrodes 23 and 24, respectively, formed on one side of one substrate, such as a flexible printed substrate, and have input side electrodes and output side electrodes electrically connected to the contact 32C provided in the apparatus main body 14 and the contacts 32A and 32B via the common input contact 30C and the respective output electrode contacts 30A and 30B. In addition, the input side electrodes 23 and the output side electrodes 24 of the measuring electrode member 20A and the reference electrode member 20B can be electrically connected respectively to the contacts provided in the apparatus main body 14 via different contacts.

Moreover, by making the placing area of the reference electrode member 20B smaller in accordance with the present invention, if the reference electrode member 20B is disposed in the image forming apparatus main body, it can be disposed in a little space in the image forming apparatus main body.

Figure 24:
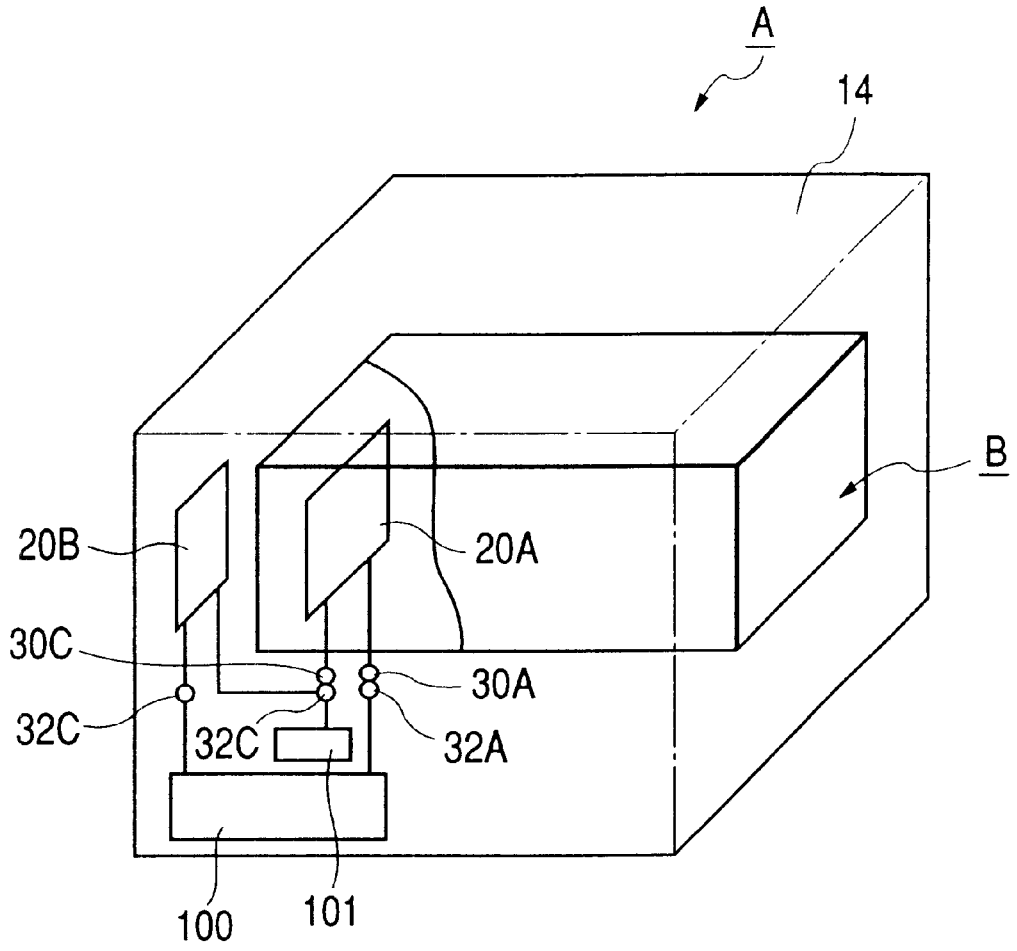
FIG. 24 is a view schematically illustrating a state of connection in the case in which a measuring electrode member is disposed in a process cartridge and a reference electrode member is disposed in an image forming apparatus main body.

Connection of the developer amount measuring apparatus when the reference electrode member 20B is provided in the image forming apparatus main body in this way will now be described. The developer amount measuring apparatus is configured by electrically connecting at least two parts, the measuring electrode member 20A and the reference electrode member 20B, to the above-mentioned developer amount detecting circuit 100 provided in the image forming apparatus main body and the developing bias impressing circuit 102 as voltage impressing means. As typically shown in FIG. 24, the input side electrode 23 of the reference electrode member 20B in the apparatus main body 14 is electrically connected directly to, and the input side electrode 23 of the measuring electrode member 20A in the process cartridge is electrically connected via the input contact 30C for measuring electrode in the process cartridge side to the common input contact 32C in the apparatus main body 14 side. In addition, the output side electrode 24 of the measuring electrode member 20A in the process cartridge is electrically connected to the output contact 32A in the apparatus main body 14 side via the output contact 30A for a measuring electrode in the process cartridge side, and the output side electrode 24 of the reference electrode member 20B in the apparatus main body 14 is electrically connected directly to the output contact 32B of the apparatus main body 14. Then, the contacts 32A and 32B in the image forming apparatus side are electrically connected to the control circuit 102 of the developer amount detecting circuit 100, and the contact 32C is electrically connected to the developing bias impressing circuit 101 as voltage impressing means.

Moreover, in accordance with the present invention, the following effects can be obtained. That is, since the costs of parts for the developer amount detecting apparatus depend on the areas of the measuring electrode member 20A and the reference electrode member 20B, the costs of parts can be reduced by reducing the area of the reference electrode member 20B without changing the variation amount of electrostatic capacitance and the accuracy of the measuring electrode member 20A. In addition, when both the electrode members 20A and 20B are fixed to the developer container 11A, the assembling work in sticking the electrode members can be improved by making the areas of the electrode members smaller and it becomes possible to decrease the assembly costs.

As described above, in accordance with the present invention, since the placing area of the reference electrode member 20B can be smaller, the developer amount detecting apparatus can be miniaturized and it is possible to miniaturize the developer container 11A or the image forming apparatus. In addition, since the electrode pattern ratio of the measuring electrode member 20A can be larger when the measuring electrode member 20A and the reference electrode member 20B are disposed in a limited space on one wall surface in the developer container, the detection accuracy can be increased. Moreover, the costs of parts and the assembly costs can be decreased by making the area of the reference electrode member 20B smaller.

Second Embodiment

An image forming apparatus of this embodiment is basically the same as the first embodiment, so members having the same function and the same configuration are given the same symbols and detailed descriptions are omitted.

Figure 25A:
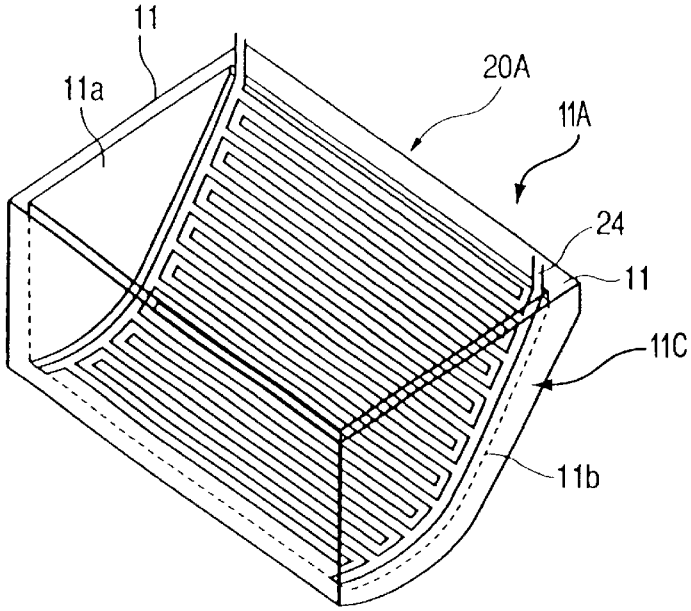
FIGS. 25A and 25B are perspective views showing a developer container and an electrode member of another embodiment of a developer amount detecting apparatus in accordance with the present invention.
Figure 25B:
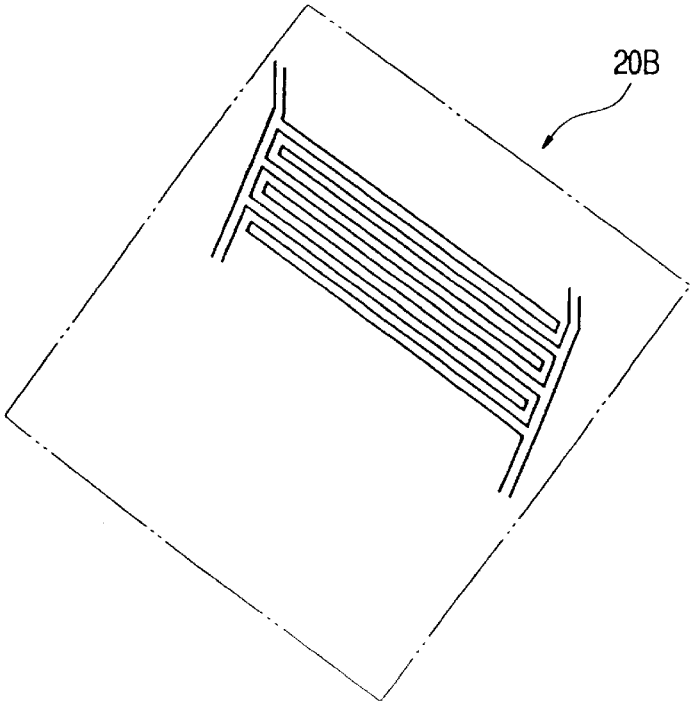

FIGS. 25A and 25B indicate another embodiment of the developer amount detecting apparatus configured in accordance with the present invention. In accordance with this embodiment, as shown in FIG. 25A, the measuring electrode member 20A is disposed in a position where the measuring electrode member 20A contacts developer on the inner bottom surface 11*b* of the developer container 11A and in a direction in which the contacting area with the developer changes as the developer decreases.

In this way, if the measuring electrode member 20A is disposed on the inner bottom surface 11*b* of the developer container 11A, the pattern area of the measuring electrode member 20A can be larger compared with the case in which the measuring electrode member 20A is disposed on the inner side wall 11*a*. That is, since the variation amount of electrostatic capacitance by the existence of developer in the developer container 11A can be secured to be large, the successive remaining amount detection of the developer can be performed by dividing the developer remaining amount smaller, i.e., with higher accuracy.

In addition, in accordance with this embodiment, as shown in FIG. 25B, the reference electrode member 20B can be provided in a part 11*c* that is partitioned by the bottom wall 11*b* of the developer container 11A, on which the measuring electrode member 20A is disposed and where the reference electrode member 20B does not contact developer.

In this embodiment as well, the electrode pattern area of the measuring electrode member 20A is relatively larger and the electrode pattern area of the reference electrode member 20B is relatively smaller. In addition, as described concerning the first embodiment, the pattern widths and the intervals of the electrode patterns of the reference electrode member 20B and the measuring electrode member 20A are substantially equal and, if the measuring electrode member 20A and the reference electrode member 20B have different configurations with different opposing areas and electrostatic capacitances, in order to successively detect a developer remaining amount, a value obtained by multiplying an output of the reference electrode member 20B by a predetermined factor, that is, (the electrode pattern area of the measuring electrode member 20A)/(the electrode pattern area of the reference electrode member 20B) is compared with an output of the measuring electrode member 20A. Moreover, for example, by widening the pattern width of the reference electrode member 20B or by narrowing the interval, it is possible to further make the pattern area smaller and, in this case, it is possible to successively detect a developer remaining amount by comparing a value obtained by multiplying an output of the reference electrode member 20B by an appropriate factor depending on the shape of the electrode pattern with an output of the measuring electrode member 20A, and the saving of space and the reduction of costs can be realized.

As described above, by providing the measuring electrode member 20A on the bottom wall 11*b* of the developer container 11A as in this embodiment, the electrode pattern area of the measuring electrode member 20A can be larger than in the case in which the measuring electrode member 20A is provided on the side wall 11*a* of the developer container 11A, and at the same time, by making the electrode pattern area of the reference electrode member 20B relatively smaller compared with that of the measuring electrode member 20A, the saving of space and the reduction of the costs of parts and the assembly costs can be realized.

Further, the description herein that the values of electrostatic capacitance arising when voltage is impressed on the electrode member is the same or equal refers not only to the case in which the values are absolutely the same, but also to the case in which the values are intended to be substantially the same or equal. Therefore, for example, an error due to dispersion and the like in manufacturing electrode members is included in the case in which the abovementioned values are the same or equal.

In addition, similarly, the descriptions that the interval between the electrode members is constant, the opposing lengths of the electrodes are the same, the interval of the opposing portions is the same, and the shapes of the measuring electrode member and the reference electrode member are the same includes the members that are intended and manufactured to have the same values or the same shapes. Therefore, for example, an error of numerical values due to dispersion and the like in manufacturing and the difference of shapes are included in the case in which the values are the same or the shapes are the same.

Moreover, as described above, in accordance with this embodiment, the measuring electrode member 20A and the reference electrode member 20B for the successive detection of a developer remaining amount are provided in the developer container 11A. In addition to this, for example, by providing an antenna rod, i.e., an electrode rod 9*h* (FIG. 3) extending by a predetermined length in the longitudinal direction of the developing roller 9*a* with a predetermined interval with the developing roller 9*a* in the developing chamber 9A of the developing means 9 and detecting a change in electrostatic capacitance between the developing roller 9*a* and the electrode rod 9*h*, the end of the developer can be detected.

In accordance with the image forming apparatus of this embodiment, as described above, by successively detecting a developer amount in the developer container 11A and indicating a consumed amount of the developer based on the information, a user can be prompted to prepare a developer supplying cartridge and further prompted to supplement developer by the detection information of the end of the developer.

Figure 26:
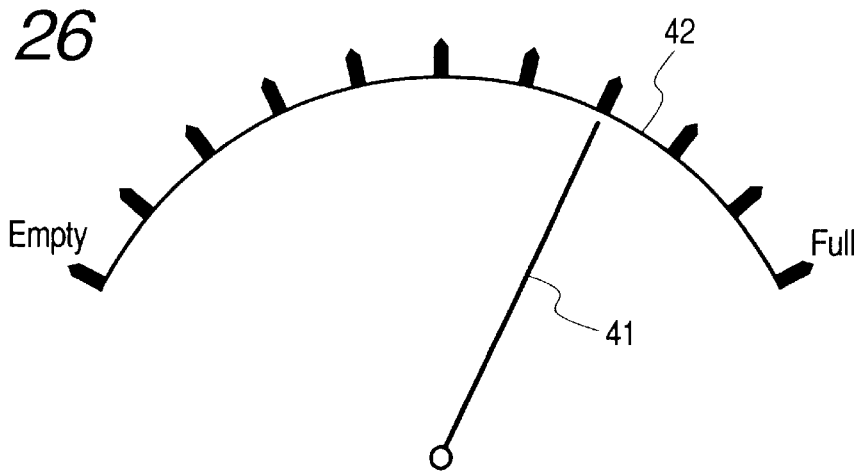
FIG. 26 illustrates an embodiment of a developer amount indication.
Figure 27:
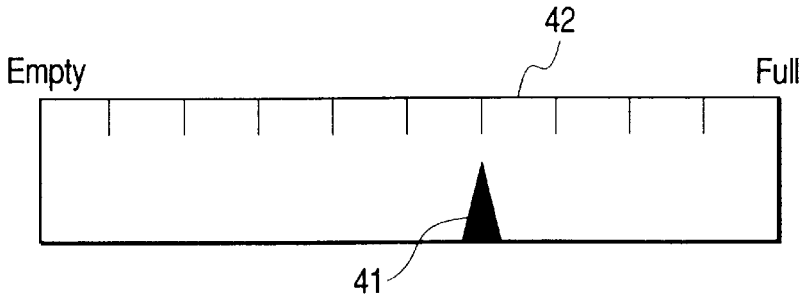
FIG. 27 illustrates another embodiment of a developer amount indication.
Figure 28:
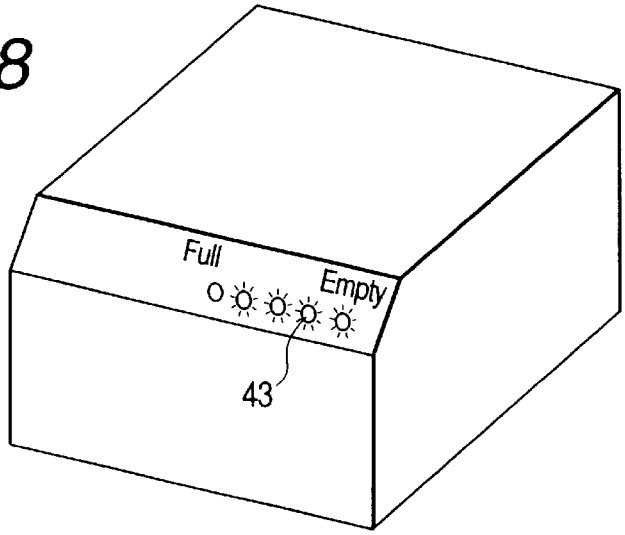
FIG. 28 illustrates another embodiment of a developer amount indication.

Concerning the method for indicating a developer amount, for example, the above-mentioned detection information by the developer amount detecting apparatus is indicated as shown in FIGS. 26 and 27 on a terminal screen such as a personal computer of a user. In FIGS. 26 and 27, the developer amount is communicated to a user depending on which part of a gauge 42 is pointed to by a pointer 41 moving in accordance with a developer amount. In addition, as shown in FIG. 28, a display portion of an LED and the like may be provided directly in the electrophotographic image forming apparatus main body to cause an LED 43 to blink in accordance with a developer amount.

Further, this embodiment is not limited to successive detection of a developer amount over all the regions from 100% to 0% when an initially filled amount of developer contained in the developer container is assumed to be 100%. For example, a developer remaining amount in the developer container may be successively detected over the region from 50% to 0%. Here, a developer remaining amount of 0% does not mean that developer is completely depleted but, for example, includes the case in which a developer remaining amount is reduced to such a level that a predetermined image quality (developing quality) cannot be obtained even if the developer still remains.

As described above, in accordance with this embodiment, the following effects can be realized:

(1) a developer remaining amount can be successively detected in accordance with the consumption of developer in the developer container forming the developer containing portion and, at the same time, the developer container can be miniaturized because only a small installation space of the reference electrode member is necessary;

(2) if the measuring electrode member and the reference electrode member are disposed in the limited area on one plane, the area ratio of the measuring electrode member can be larger to improve the detection accuracy; and (3) by reducing the area of the reference electrode member, the costs of parts and the assembly costs can be decreased.

In addition, in accordance with this embodiment, a developer amount detecting member to be provided in a process cartridge and an electrophotographic image forming apparatus that can realize the above-mentioned effects are provided.

As described above, in accordance with the present invention, a developer remaining amount can be successively detected with a miniaturized structure.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main body of an electrophotographic image forming apparatus, said process cartridge comprising:

(a) an electrophotographic photosensitive member;

(b) process means for acting on said electrophotographic photosensitive member;

(c) a measuring electrode member disposed in a part to be in contact with developer and provided with an input side electrode and an output side electrode having at least a pair of portions juxtaposed at a constant interval;

(d) a reference electrode member disposed in a part out of contact with the developer and provided with an input side electrode and an output side electrode having at least a pair of portions juxtaposed at a constant interval;

(e) a measuring electrode output contact electrically connected to said output side electrode of said measuring electrode member;

(f) a reference electrode output contact electrically connected to said output side electrode of said reference electrode member; and (g) an input contact electrically connected to said input side electrodes of said measuring electrode member and said reference electrode member, wherein values of the electrostatic capacitance respectively generated by said measuring electrode member and said reference electrode member are different when voltage is impressed on said measuring electrode member and said reference electrode member with said process cartridge being mounted to said main body, and wherein the value of the electrostatic capacitance generated by said measuring electrode member is relatively larger than the value of the electrostatic capacitance generated by said reference electrode member.

2. A process cartridge according to claim 1, wherein the values of electrostatic capacitance respectively generated by said measuring electrode member and said reference electrode member when voltage is impressed on said measuring electrode member and said reference electrode member with said process cartridge being mounted to said main body of said electrophotographic image forming apparatus are made equal by multiplying the value of the electrostatic capacitance generated by said reference electrode member by a predetermined factor.

3. A process cartridge according to claim 1, wherein among areas of electrode patterns provided in said measuring electrode member and said reference electrode member, the area of the electrode pattern of said measuring electrode member is relatively larger than the area of the electrode pattern of said reference electrode member.

4. A process cartridge according to claim 1, wherein said measuring electrode member is different from said reference electrode member in intervals of opposing portions of said input side electrode and said output side electrode juxtaposed at the constant intervals of said measuring electrode member and said reference electrode member.

5. A process cartridge according to claim 1, wherein said measuring electrode member is the same as said reference electrode member in intervals of opposing portions of said input side electrode and said output side electrode juxtaposed at the constant intervals of said measuring electrode member and said reference electrode member.

6. A process cartridge according to claim 1, wherein said measuring electrode member is different from said reference electrode member in widths of said input side electrode and said output side electrode juxtaposed at the constant intervals of said measuring electrode member and said reference electrode member.

7. A process cartridge according to claim 1, wherein said measuring electrode member is the same as said reference electrode member in widths of said input side electrode and said output side electrode juxtaposed at the constant intervals of said measuring electrode member and said reference electrode member.

8. A process cartridge according to claim 1, wherein said measuring electrode member is disposed in a part to be in contact with the developer in a developer containing portion for containing the developer used for development of an electrostatic latent image by developing means as said process means.

9. A process cartridge according to claim 1, wherein said reference electrode member is disposed in a part out of contact with the developer in a developer containing portion for containing the developer used for development of an electrostatic latent image by developing means as said process means.

10. A process cartridge according to claim 1, wherein said measuring electrode member is disposed in the internal side surface of a developer containing portion.

11. A process cartridge according to claim 1, wherein said measuring electrode member is disposed on an internal bottom surface of a developer containing portion.

12. A process cartridge according to claim 1, wherein said reference electrode member is disposed outside a developer containing portion.

13. A process cartridge according to claim 1, wherein said reference electrode member is provided in a part of an identical plane on which said measuring electrode member in a developer containing portion is disposed, said part being partitioned by a partition plate not to be in contact with the developer.

14. A process cartridge according to claim 1, wherein said measuring electrode member and said reference electrode member are manufactured by forming electrode patterns on an identical surface of an identical substrate.

15. A process cartridge according to claim 1, wherein said input contact electrically connected to said input side electrodes of said measuring electrode member and said reference electrode member is a single common input contact.

16. A process cartridge detachably mountable to a main body of an electrophotographic image forming apparatus, said electrophotographic image forming apparatus having a reference electrode member disposed in a part out of contact with developer, said reference electrode member being provided with an input side electrode and an output side electrode having at least a pair of portions juxtaposed at a constant interval, said process cartridge comprising:

(a) an electrophotographic photosensitive member;

(b) process means for acting on said electrophotographic photosensitive member;

(c) a measuring electrode member disposed in a part to be in contact with the developer and provided with an input side electrode and an output side electrode having at least a pair of portions juxtaposed at a constant interval;

(d) a measuring electrode output contact electrically connected to said output side electrode of said measuring electrode member; and (e) an input contact electrically connected to said input side electrode of said measuring electrode member, wherein values of the electrostatic capacitance respectively generated by said measuring electrode member and said reference electrode member are different when voltage is impressed on said measuring electrode member and said reference electrode member with said process cartridge being mounted to said main body, and wherein the value of the electrostatic capacitance generated by said measuring electrode member is relatively larger than the value of the electrostatic capacitance generated by said reference electrode member is relatively smaller.

17. A process cartridge according to claim 16, wherein the values of the electrostatic capacitance respectively generated by said measuring electrode member and said reference electrode member when voltage is impressed on said measuring electrode member and said reference electrode member with said process cartridge being mounted to said main body of said electrophotographic image forming apparatus are made equal by multiplying the value of the electrostatic capacitance generated by said reference electrode member by a predetermined factor.

18. A process cartridge according to claim 16, wherein among areas of electrode patterns provided in said measuring electrode member and said reference electrode member, the area of the electrode pattern of said measuring electrode member is relatively larger than the area of the electrode pattern of said reference electrode member.

19. A process cartridge according to claim 16, wherein said measuring electrode member is different from said reference electrode member in intervals of opposing portions of said input side electrode and said output side electrode juxtaposed at the constant intervals of said measuring electrode member and said reference electrode member.

20. A process cartridge according to claim 16, wherein said measuring electrode member is the same as said reference electrode member in intervals of opposing portions of said input side electrode and said output side electrode juxtaposed at the constant intervals of said measuring electrode member and said reference electrode member.

21. A process cartridge according to claim 16, wherein said measuring electrode member is different from said reference electrode member in widths of said input side electrode and said output side electrode juxtaposed at the constant intervals of said measuring electrode member and said reference electrode member.

22. A process cartridge according to claim 16, wherein said measuring electrode member is the same as said reference electrode member in widths of said input side electrode and said output side electrode juxtaposed at the constant intervals of said measuring electrode member and said reference electrode member.

23. A process cartridge according to claim 16, wherein said measuring electrode member is disposed in a part to be in contact with the developer in a developer containing portion for containing the developer used for development of an electrostatic latent image by developing means as said process means.

24. A process cartridge according to claim 16, wherein said measuring electrode member is disposed on an internal side surface of a developer containing portion.

25. A process cartridge according to claim 16, wherein said measuring electrode member is disposed on an internal bottom surface of a developer containing portion.

26. A process cartridge according to claim 16, wherein said process cartridge makes at least one of charging means, developing means and cleaning means as said process means and said electrophotographic photosensitive member integrally into a cartridge which is detachably mountable to said main body of said electrophotographic image forming apparatus.

27. A process cartridge according to claim 16, wherein said process cartridge makes at least developing means as said process means and said electrophotographic photosensitive member integrally into a cartridge which is detachably mountable to said main body of said electrophotographic image forming apparatus.

28. An electrophotographic image forming apparatus to which a process cartridge is detachably mountable for forming an image on a recording medium, said electrophotographic image forming apparatus comprising:

(a) mounting means for detachably mounting a process cartridge, said process cartridge comprising:
an electrophotographic photosensitive member;
process means for acting on said electrophotographic photosensitive member;
a measuring electrode member disposed in a part to be in contact with developer and provided with an input side electrode and an output side electrode having at least a pair of portions juxtaposed at a constant interval;
a reference electrode member disposed in a part out of contact with the developer and provided with an input side electrode and an output side electrode having at least a pair of portions juxtaposed at a constant interval;

a measuring electrode output contact electrically connected to said output side electrode of said measuring electrode member;

a reference electrode output contact electrically connected to said output side electrode of said reference electrode member; and an input contact electrically connected to said input side electrodes of said measuring electrode member and said reference electrode member, wherein values of the electrostatic capacitance respectively generated by said measuring electrode member and said reference electrode member are different when voltage is impressed on said measuring electrode member and said reference electrode member with said process cartridge being mounted to a main body of said electrophotographic image forming apparatus, and wherein the value of the electrostatic capacitance generated by said measuring electrode member is relatively larger than the value of electrostatic capacitance generated by said reference electrode member; and (b) latent image forming means for forming an electrostatic latent image on said electrophotographic photosensitive member.

29. An electrophotographic image forming apparatus according to claim 28, wherein the values of the electrostatic capacitance respectively generated by said measuring electrode member and said reference electrode member when voltage is impressed on said measuring electrode member and said reference electrode member with said process cartridge being mounted to said main body of said electrophotographic image forming apparatus are made equal by multiplying the value of the electrostatic capacitance generated by said reference electrode member by a predetermined factor.

30. An electrophotographic image forming apparatus according to claim 28, wherein among areas of electrode patterns provided in said measuring electrode member and said reference electrode member, the area of the electrode pattern of said measuring electrode member is relatively larger than the area of the electrode pattern of said reference electrode member.

31. An electrophotographic image forming apparatus according to claim 28, wherein said measuring electrode member is different from said reference electrode member in intervals of opposing portions of said input side electrode and said output side electrode juxtaposed at the constant intervals of said measuring electrode member and said reference electrode member.

32. An electrophotographic image forming apparatus according to claim 28, wherein said measuring electrode member is the same as said reference electrode member in intervals of opposing portions of said input side electrode and said output side electrode juxtaposed at the constant intervals of said measuring electrode member and said reference electrode member.

33. An electrophotographic image forming apparatus according to claim 28, wherein said measuring electrode member is different from said reference electrode member in widths of said input side electrode and said output side electrode juxtaposed at the constant intervals of said measuring electrode member and said reference electrode member.

34. An electrophotographic image forming apparatus according to claim 28, wherein said measuring electrode member is the same as said reference electrode member in widths of said input side electrode and said output side electrode juxtaposed at the constant intervals of said measuring electrode member and said reference electrode member.

35. An electrophotographic image forming apparatus according to claim 28, wherein said measuring electrode member is disposed in a part to be in contact with the developer in a developer containing portion for containing the developer used for development of an electrostatic latent image by developing means as said process means.

36. An electrophotographic image forming apparatus according to claim 28, wherein said reference electrode member is disposed in a part out of contact with the developer in a developer containing portion for containing the developer used for development of an electrostatic latent image by developing means as said process means.

37. An electrophotographic image forming apparatus according to claim 28, wherein said measuring electrode member is disposed on an internal side surface of a developer containing portion.

38. An electrophotographic image forming apparatus according to claim 28 wherein said measuring electrode member is disposed on an internal bottom surface of a developer containing portion.

39. An electrophotographic image forming apparatus according to claim 28, wherein said reference electrode member is disposed outside a developer containing portion.

40. An electrophotographic image forming apparatus according to claim 28, wherein said reference electrode member is provided in a part of an identical plane on which said measuring electrode member in a developer containing portion is disposed, said part being partitioned by a partition plate not to be in contact with the developer.

41. An electrophotographic image forming apparatus according to claim 28, wherein said measuring electrode member and said reference electrode member are manufactured by forming electrode patterns on an identical surface of an identical substrate.

42. An electrophotographic image forming apparatus according to claim 28, wherein said input contact electrically connected to said input side electrodes of said measuring electrode member and said reference electrode member is a single common input contact.

43. An electrophotographic image forming apparatus according to claim 28, wherein an apparatus main body side input contact electrically connected to said input contact of said measuring electrode member and said reference electrode member of said process cartridge is a single common apparatus main body side input contact.

44. An electrophotographic image forming apparatus to which a process cartridge is detachably mountable for forming an image on a recording medium, said electrophotographic image forming apparatus comprising:

(a) mounting means for detachably mounting a process cartridge, said process cartridge comprising:

an electrophotographic photosensitive member;

process means for acting on said electrophotographic photosensitive member;

a measuring electrode member disposed in a part to be in contact with the developer and provided with an input side electrode and an output side electrode having at least a pair of portions juxtaposed at a constant interval;

a measuring electrode output contact electrically connected to said output side electrode of said measuring electrode member; and an input contact electrically connected to said input side electrode of said measuring electrode member;

(b) a reference electrode member disposed in a part out of contact with the developer and provided with an input side electrode and an output side electrode having at least a pair of portions juxtaposed at a constant interval; and (c) latent image forming means for forming an electrostatic latent image on said electrophotographic photosensitive member, wherein values of the electrostatic capacitance respectively generated by said measuring electrode member and said reference electrode member are different when voltage is impressed on said measuring electrode member and said reference electrode member with said process cartridge being mounted to a main body of said electrophotographic image forming apparatus, and wherein the value of the electrostatic capacitance generated by said measuring electrode member is relatively larger than the value of the electrostatic capacitance generated by said reference electrode member.

45. An electrophotographic image forming apparatus according to claim 44, wherein the values of the electrostatic capacitance respectively generated by said measuring electrode member and said reference electrode member when voltage is impressed on said measuring electrode member and said reference electrode member with said process cartridge being mounted to said main body of said electrophotographic image forming apparatus are made equal by multiplying the value of the electrostatic capacitance generated by said reference electrode member by a predetermined factor.

46. An electrophotographic image forming apparatus according to claim 44, wherein among areas of electrode patterns provided in said measuring electrode member and said reference electrode member, the area of the electrode pattern of said measuring electrode member is relatively larger than the area of the electrode pattern of said reference electrode member.

47. An electrophotographic image forming apparatus according to claim 44, wherein said measuring electrode member is different from said reference electrode member in intervals of opposing portions of said input side electrode and said output side electrode juxtaposed at the constant intervals of said measuring electrode member and said reference electrode member.

48. An electrophotographic image forming apparatus according to claim 44, wherein said measuring electrode member is the same as said reference electrode member in intervals of opposing portions of said input side electrode and said output side electrode juxtaposed at the constant intervals of said measuring electrode member and said reference electrode member.

49. An electrophotographic image forming apparatus according to claim 44, wherein said measuring electrode member is different from said reference electrode member in widths of said input side electrode and said output side electrode juxtaposed at the constant intervals of said measuring electrode member and said reference electrode member.

50. An electrophotographic image forming apparatus according to claim 44, wherein said measuring electrode member is the same as said reference electrode member in widths of said input side electrode and said output side electrode juxtaposed at the constant intervals of said measuring electrode member and said reference electrode member.

51. An electrophotographic image forming apparatus according to claim 44, wherein said measuring electrode member is disposed in a part to be in contact with the developer in a developer containing portion for containing the developer used for development of an electrostatic latent image by developing means as said process means.

52. An electrophotographic image forming apparatus according to claim 44, wherein said measuring electrode member is disposed on an internal side surface of a developer containing portion.

53. An electrophotographic image forming apparatus according to claim 44, wherein said measuring electrode member is disposed on an internal bottom surface of a developer containing portion.

54. An electrophotographic image forming apparatus according to claim 28 or 44, wherein said process cartridge makes at least one of charging means, developing means and cleaning means as said process means and said electrophotographic photosensitive member integrally into a cartridge which is detachably mountable to said main body of said electrophotographic image forming apparatus.

55. An electrophotographic image forming apparatus according to claim 28 or 44, wherein said process cartridge makes at least developing means as said process means and said electrophotographic photosensitive member integrally into a cartridge which is detachably mountable to said main body of said electrophotographic image forming apparatus.

56. A developer amount detecting member having an electrode member provided with an input side electrode and an output side electrode having at least a pair of portions juxtaposed at a constant interval, said developer amount detecting member comprising:

a measuring electrode member disposed in a part to be in contact with developer; and a reference electrode member disposed in a part out of contact with the developer, wherein values of the electrostatic capacitance respectively generated by said measuring electrode member and said reference electrode member are different when voltage is impressed on said measuring electrode member and said reference electrode member, and wherein the value of the electrostatic capacitance generated by said measuring electrode member is relatively larger than the value of the electrostatic capacitance generated by said reference electrode member.

57. A developer amount detecting member according to claim 56, wherein the values of the electrostatic capacitance respectively generated by said measuring electrode member and said reference electrode member when voltage is impressed on said measuring electrode member and said reference electrode member are made equal by multiplying the value of the electrostatic capacitance generated by said reference electrode member by a predetermined factor.

58. A developer amount detecting member according to claim 56, wherein among areas of electrode patterns provided in said measuring electrode member and said reference electrode member, the area of the electrode pattern of said measuring electrode member is relatively larger than the area of the electrode pattern of said reference electrode member.

59. A developer amount detecting member according to claim 56, wherein said measuring electrode member is different from said reference electrode member in intervals of opposing portions of said input side electrode and said output side electrode juxtaposed at the constant intervals of said measuring electrode member and said reference electrode member.

60. A developer amount detecting member according to claim 56, wherein said measuring electrode member is the same as said reference electrode member in intervals of opposing portions of said input side electrode and said output side electrode juxtaposed at the constant intervals of said measuring electrode member and said reference electrode member.

61. A developer amount detecting member according to claim 56, wherein said measuring electrode member is different from said reference electrode member in widths of said input side electrode and said output side electrode juxtaposed at the constant intervals of said measuring electrode member and said reference electrode member.

62. A developer amount detecting member according to claim 56, wherein said measuring electrode member is the same as said reference electrode member in widths of said input side electrode and said output side electrode juxtaposed at the constant intervals of said measuring electrode member and said reference electrode member.

63. A developer amount detecting member according to claim 56, wherein said measuring electrode member and said reference electrode member are manufactured by forming electrode patterens on a identical surface of an identical substrate.

* * * * *

UNITED STATES PATENT AND TRADEMARK OFFICE

CERTIFICATE OF CORRECTION

PATENT NO. : 6,377,759 B1
DATED : April 23, 2002
INVENTOR(S) : Daisuke Abe et al.

It is certified that error appears in the above-identified patent and that said Letters Patent is hereby corrected as shown below:

Column 1,
Line 60, “an” should read -- a --.

Column 6,
Line 32, “a” should be deleted.

Column 8,
Line 6, “amountdetection” should read -- amount detection --.

Column 26,
Line 10, “a” should read -- an --.

Signed and Sealed this

Eleventh Day of March, 2003

JAMES E. ROGAN
*Director of the United States Patent and Trademark Office*